US010413942B2

(12) United States Patent
Solenthaler et al.

(10) Patent No.: US 10,413,942 B2
(45) Date of Patent: Sep. 17, 2019

(54) SCREENING SYSTEM, EDDY-CURRENT SCREENING MACHINE, AND USE OF A SCREENING SYSTEM OR OF AN EDDY-CURRENT SCREENING MACHINE

(71) Applicant: TELSONIC HOLDING AG, Bronschhofen (CH)

(72) Inventors: Peter Solenthaler, St. Margarethen (CH); Reto Sutter, Goldach (CH)

(73) Assignee: Telsonic Holding AG, Bronschhofen (CH)

( * ) Notice: Subject to any disclaimer, the term of this patent is extended or adjusted under 35 U.S.C. 154(b) by 36 days.

(21) Appl. No.: 15/556,475

(22) PCT Filed: Mar. 10, 2016

(86) PCT No.: PCT/EP2016/055099
§ 371 (c)(1),
(2) Date: Sep. 7, 2017

(87) PCT Pub. No.: WO2016/142454
PCT Pub. Date: Sep. 15, 2016

(65) Prior Publication Data

US 2018/0078971 A1 Mar. 22, 2018

(30) Foreign Application Priority Data

Mar. 10, 2015 (WO) ..... PCT/EP2015/054936
Jul. 2, 2015 (WO) ..... PCT/EP2015/065093
Dec. 1, 2015 (EP) ..... 15197213

(51) Int. Cl.
*B07B 1/18* (2006.01)
*B07B 1/42* (2006.01)
(Continued)

(52) U.S. Cl.
CPC ..... *B07B 1/18* (2013.01); *B07B 1/40* (2013.01); *B07B 1/42* (2013.01); *B07B 1/46* (2013.01); *B07B 2230/04* (2013.01)

(58) Field of Classification Search
CPC .... B07B 1/18; B07B 1/40; B07B 1/42; B07B 2230/04
See application file for complete search history.

(56) References Cited

U.S. PATENT DOCUMENTS 5,213,216 A * 5/1993 Suehiro ..... B01D 33/0346 209/236
5,653,346 A * 8/1997 Frei ..... B01D 33/0346 209/254
(Continued)

FOREIGN PATENT DOCUMENTS

DE 198 11 266 C1 8/1999
DE 20 2012 101 287 U1 6/2012
(Continued)

OTHER PUBLICATIONS

International Search Report Corresponding to PCT/EP2016/055099 dated Sep. 6, 2016.
(Continued)

*Primary Examiner* — Joseph C Rodriguez
(74) *Attorney, Agent, or Firm* — Davis & Bujold PLLC; Michael J. Bujold

(57) ABSTRACT

A screening system (10) comprising at least one first substantially annular screen support (11) and a second substantially annular screen support (12); at least one pressure rod (14), which braces the screen supports (11, 12) with each other in such a manner that a compressive stress is produced between the screen supports (11, 12); at least one substantially cylindrical outer screen surface (13), which is clamped between the screen supports (11, 12); and at least one resonator (15) for the introduction of ultrasonic vibrations
(Continued)

Figure 1:
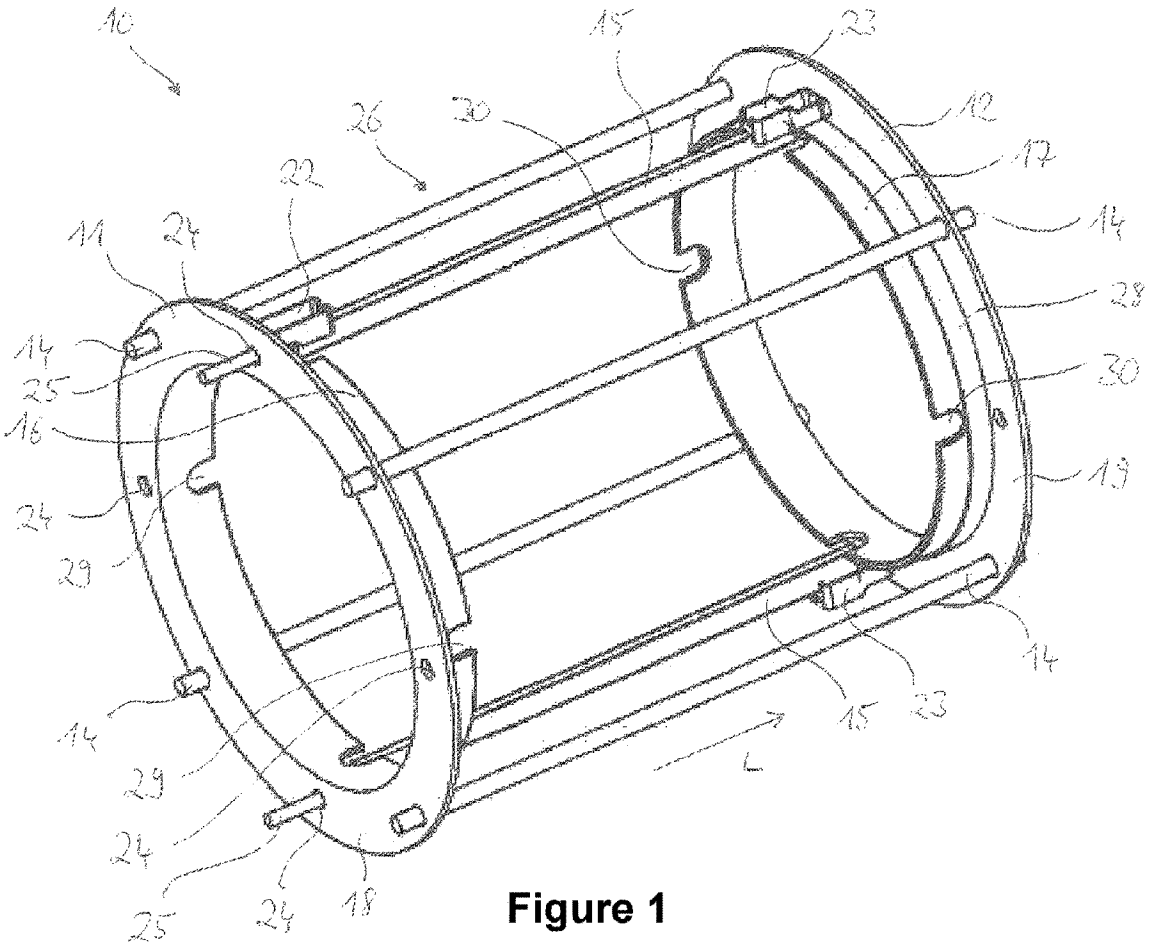

directly into the screen surface (13). The resonator (15) may be fastened to the screen surface (13) and essentially runs from the first screen support (11) to the second screen support (12). An eddy-current screening machine is also disclosed.

18 Claims, 15 Drawing Sheets

(51) Int. Cl.
*B07B 1/40* (2006.01)
*B07B 1/46* (2006.01)

(56) References Cited

U.S. PATENT DOCUMENTS 5,799,799 A * 9/1998 Alamzad ..... B07B 1/42 209/365.1
5,915,566 A * 6/1999 Senapati ..... B01D 33/0376 209/365.1
6,079,569 A * 6/2000 Monteith ..... B06B 3/00 209/346
6,845,868 B1 * 1/2005 Krush ..... B07B 1/42 209/332
7,182,206 B2 * 2/2007 Hukki ..... B07B 1/42 209/365.1
7,694,826 B2 * 4/2010 Garrett ..... B07B 1/40 209/365.1
8,453,845 B2 6/2013 Kising
8,564,226 B2 * 10/2013 Kising ..... B65G 27/00 310/311
8,973,759 B2 * 3/2015 Ichikawa ..... B07B 1/06 209/254
2005/0072717 A1 * 4/2005 Purohit ..... B07B 1/36 209/309
2010/0117564 A1 * 5/2010 Kising ..... B65G 27/00 318/114
2010/0258482 A1 * 10/2010 Jurgen ..... B07B 1/18 209/287
2018/0021816 A1 * 1/2018 Schenk ..... B07B 1/26 209/238

FOREIGN PATENT DOCUMENTS

DE 10 2012 104 577 A1 12/2013
DE 20 2012 011 921 U1 4/2014
EP 2067534 A1 6/2009
JP 2011-245446 A 12/2011
WO 2009/071221 A1 6/2009

OTHER PUBLICATIONS

International Search Report Corresponding to PCT/EP2015/054936 dated Nov. 18, 2015.
International Search Report Corresponding to PCT/EP2015/065093 dated Nov. 18, 2015.
Written Opinion Corresponding to PCT/EP2016/055099 dated Sep. 6, 2016.

* cited by examiner

SCREENING SYSTEM, EDDY-CURRENT SCREENING MACHINE, AND USE OF A SCREENING SYSTEM OR OF AN EDDY-CURRENT SCREENING MACHINE

The present invention is concerned with screening systems with screen surfaces, which are substantially in the form of lateral cylinder surfaces, in particular substantially in the form of circular lateral cylinder surfaces, and resonators for introducing ultrasound vibrations according to the preamble of independent claim 1 as well as with eddy-current screening machines and with uses of screening systems or eddy-current screening machines.

Such types of screening systems with, for example, screen surfaces in the form of circular lateral cylinder surfaces, can be used, for example, in eddy-current screening machines which are known per se. In such eddy-current screening machines, screening material is introduced into a screening chamber where it is excited to form an eddy current by means of a rotor which is arranged in an interior that is surrounded by the screen surface. As a result, fine material is conveyed through the screen surface, whilst coarse material is conveyed to a coarse material outlet arranged on the end of the screen surface.

Supporting the conveying of fine material through the screen surface by means of ultrasound vibrations has already been disclosed in the prior art. All of the disclosed solutions, however, have disadvantages:

DE 10 2012 104 577 A1 discloses, for example, a cylinder screen for a screening machine. In one exemplary embodiment, a screen basket includes three sleeves, between which a plastics material screen fabric is clamped. The sleeves are braced together by means of struts. The screen basket is connected via vibration transferring means directly to vibration generators which are fastened on one of the sleeves. The vibration generators vibrate at a frequency of between 30 and 200 Hz or also at ultrasound frequencies.

However, as the vibration transferring means are fastened on one of the sleeves, the ultrasound vibrations are only transferred indirectly to the screen fabric. In order, nevertheless, to obtain sufficient ultrasound amplitudes in the screen fabric, the vibration transferring means must consequently already vibrate at a high ultrasound amplitude, which results in a large amount of, and for the purpose of screening actually unnecessary, expenditure of energy and, as a result, also in an unnecessary increase in temperature.

German utility model DE 20 2012 011 921 U1 shows a screening device, the screen deck of which is compacted by a deformation process. The screen deck can be excited using an ultrasound generator. One embodiment of the screening device includes a screen cylinder for use in an eddy-current screening machine. The screen fabric of the screening device is bonded to three sleeves, the two outer sleeves of which are pressed apart from one another by means of a clamping device with three threaded rods. The vibrations are transmitted to the screen fabric exclusively via the middle sleeve by means of a feed bar.

No direct excitation of the screen fabric takes place here either such that sufficient ultrasound introduction into the screen fabric is only possible at a relatively high energy input.

German utility model DE 20 2012 101 287 U1 discloses a cylindrical or frustoconical screen basket. Said screen basket comprises a screen fabric which consists of metal wires which are sintered together. By means of vibration transmitters and connection pieces, vibrations are transmitted to a central sleeve on which the screen surfaces are fastened. Two vibration generators are preferably provided, one in the ultrasound range and one in a low-frequency range.

Similarly to DE 10 2012 104 577 A1, however, the vibration transmitters are not fastened on the screen surfaces here either such that no sufficient ultrasound introduction into the screen fabric can be effected in the case of said known screening system either.

WO 2009/071221 A1 discloses a screening system with a tubular screen. To increase efficiency, it is necessary to vibrate the screen in such a manner that the amplitude of the ultrasound vibration comprises a component both in the radial and in the axial direction of the tubular screen. Two ultrasound converters and two supplying sound conductors, which are connected to a screen frame at contact points, are provided in one of the exemplary embodiments.

Here too, the vibrations are only transmitted onto the screen frame such that, once again, no satisfactory ultrasound introduction is effected.

All in all, the prior art therefore allows ultrasound vibrations to be introduced into screen surfaces which are in the form of lateral cylinder surfaces. However, the ultrasound vibrations are always introduced into the screen supports which support the screen surface. In order to be able to obtain sufficient ultrasound amplitudes in the screen surface in spite of this, the primary ultrasound amplitudes must consequently already be chosen to be so large that the losses can be compensated for. This results in energy expenditure which is unnecessarily high for the actual purpose of screening and in unnecessarily high temperatures.

It is consequently an object of the present invention to improve the screening systems disclosed in the prior art further in such a manner that the named disadvantages are eliminated or at least reduced. In particular, the screening system is therefore intended to allow ultrasound vibrations to be introduced in a particularly effective manner into the screen surface, wherein as little energy as possible is applied.

Said object is achieved, on the one hand, by a screening system which includes:

- at least one first substantially annular screen support and a second substantially annular screen support,
- at least one pressure rod which braces the screen supports together in such a manner that compressive stress is generated between the screen supports,
- at least one screen surface which is substantially in the form of a lateral cylinder surface and is clamped between the screen supports,
- at least one resonator for introducing ultrasound vibrations directly into the screen surface, wherein the resonator forms in particular the pressure rod.

The screen surface can be realized, for example, as a screen fabric. The screen surface extends along a longitudinal direction between the screen supports. The screen supports are realized and arranged relative to one another in such a manner that the screen surface clamped between them is substantially in the form of a cylinder outer casing. A surface (in particular a screen surface) in the form of a lateral cylinder surface is to be understood, in this connection, as a surface which is produced as one entity by sections which all run parallel to the named longitudinal direction. The two screen supports define two top surfaces of the cylinder. In a preferred manner, the longitudinal direction and consequently also the named sections run substantially perpendicular to said top surfaces, such that a straight lateral cylinder surface is produced. However, skew lateral cylinder surfaces where the longitudinal direction, and consequently also the sections, do not run substantially perpendicular to the top surfaces, are also conceivable and are within the framework of the invention.

It is particularly advantageous when both the first and the second screen supports are realized in a substantially circular ring-shaped manner and the screen surface is realized substantially in the form of a circular cylinder outer casing. In cross sectional planes which run perpendicular to the top surfaces defined by the screen supports (and parallel to the longitudinal direction in the case of a straight cylinder), the screen surface is therefore realized in the form of a circumference. As a result, the conveying of the screening material through the screen surface by means of a rotor, already described in the introduction, is particularly effective and uniform. However, it is also within the framework of the invention for the screen surface to have other forms in the named cross sectional planes and to be realized, for example, in a polygonal manner, such as, for example, in the form of a rectangle or a hexagon.

As a result of clamping the screen surface, tensile stress, which is compensated for by the compressive stress generated by the pressure rod, is generated between the screen supports. The pressure rod also extends in a preferred manner in the longitudinal direction. In a preferred manner, the resonator is realized and arranged in such a manner that it is actuatable by ultrasound vibrations at a pre-defined frequency (for example by means of an ultrasound conductor which is described again further below) in order to vibrate in resonance. To vibrate in resonance is to be understood in this case not only as vibrating at a maximum resonance curve, but also within a certain frequency rage around said maximum, for example within a frequency range of approximately 3 dB around the maximum. The resonator can be realized as a hollow profile and consist of materials that are known per se, such as, for example, chrome steel or plastics material.

In some embodiments, the resonator can form the pressure rod, and can therefore brace the screen supports together, itself, in such a manner that compressive stress is generated between the screen supports; in said embodiments there is no need necessarily for further pressure rods. In other embodiments, the resonator is not a pressure rod which braces the screen supports together in such a manner that compressive stress is generated between the screen supports.

According to the invention, the resonator is fastened on the screen surface and extends substantially from the first screen support to the second screen support. However, the resonator does not necessarily have to be held by the first and/or by the second screen support. In a preferred manner, the resonator extends along at least 60%, further preferred at least 80% and even further preferred at least 90%, of the length of the screen surface measured in the longitudinal direction of the screen surface.

On account of the fastening of the resonator directly on the screen surface, the ultrasound vibrations can be introduced directly from the resonator into the screen surface. The introduction is therefore not effected exclusively indirectly by means of a screen support or a different screen frame. Consequently, ultrasound vibrations do not have to be introduced into the screen supports. As a result, less ultrasound energy has to be applied in order to introduce the ultrasound vibrations into the screen surface. As, according to the invention, the resonator additionally extends substantially from the first screen support to the second screen support, the introduction of the ultrasound energy into the screen surface is increased even more.

The screen surface can comprise a length of within the range of between 100 mm and 1000 mm and a diameter of within the range of between 100 mm and 500 mm.

The resonator can be held (directly or indirectly) on the first screen support and/or on the second screen support. Consequently, no further components are required to hold the resonator (apart from possible decoupling elements which are described again further below). In this case, it is particularly preferred when the resonator is held (directly or indirectly) both on the first screen support and on the second screen support. For then the compressive stress necessary for clamping the screen surface between the two screen supports can be built up not only by the pressure rod, but additionally by the resonator. As already explained, the pressure rod can also be formed by the resonator such that apart from the resonator no further pressure rods are necessary.

The resonator can comprise one or multiple vibration nodes. In a preferred manner, it comprises a first vibration node, on which it is held (directly or indirectly) on the first screen support, and/or a second vibration node, on which it is held (directly or indirectly) on the second screen support. The advantage of holding the resonator on a vibration node is that substantially no ultrasound vibrations are transmitted from the resonator to the respective screen support. Consequently, the transmission of ultrasound energy to components (namely the screen supports) which do not have to be excited at all for the actual function of screening is consequently also substantially prevented. Sound introduction is consequently more efficient.

It is particularly advantageous, in this connection, when the resonator on the first vibration node is held on the first screen support by means of a first decoupling element and/or on the second vibration node is held on the second screen support by means of a second decoupling element; the resonator is then therefore held indirectly on the first and/or second screen support. The transmission of ultrasound onto the screen supports, unnecessary to the method of operation of the screening system, can be reduced even further using such decoupling elements. The vibration nodes are arranged in a preferred manner in this case in oppositely situated end regions of the resonator. A shorter axial installation length of the decoupling elements can be achieved as a result.

So that the resonator can be fastened on the screen supports and can also transmit compressive forces, it is preferred when at least one of the decoupling elements is connected to the respective screen support by means of a clamping device, for example when the second decoupling element is connected to the second screen support by means of the clamping device. The clamping device can be formed, for example, by a clamping element which is provided with an external thread and is fixedly connected to the second decoupling element, a bore formed in the second screen support and two clamping nuts. As a result of interaction between the external thread and the bore and the clamping nuts, the clamping element can be fastened and braced on the second screen support. The named bore can be formed, for example, in a collar-shaped portion of the second screen support which is described again below. The first decoupling element can also be connected to the first screen support by means of a clamping device. However, when the second decoupling element is already connected to the second screen support by means of a clamping device, the first decoupling element can also be connected fixedly to the first screen support, for example as a result of welding or screw-connecting.

In many exemplary embodiments, the advantage of the named decoupling elements is also that, during assembly, they protect a resonator that is already fastened on the screen surface against rotation, which could impair or destroy the fastening. In many cases, it is possible in this way, in said exemplary embodiments, to dispense with an anti-rotation safeguard which is described again below.

The pressure rod can also be connected to one or both screen supports by means of a clamping device as described above, it being sufficient when it is only connected to the second screen support by means of clamping device, but is fixedly connected to the first screen support, for example, as a result of welding or screw-connecting.

In order to enable both clamping the screen surface and fastening the pressure rod, at least one and in a preferred manner both screen supports can comprise a sleeve-shaped portion on which the screen surface is fastened, as well as a collar-shaped portion which protrudes radially outward from the sleeve-shaped portion and on which at least one of the pressure rods is fastened. Such a sleeve-shaped portion enables the screen surface to be fastened without it having to be kinked or turned. It is also advantageous when the screen surface is fastened on the outer side of the sleeve-shaped portion. The screen surface can then, namely, be fastened on the sleeve-shaped portion, for example by means of a clamping ring or a hose clip and consequently be braced in the axial direction. In addition, the screen surface can be bonded on the support, in particular on the sleeve-shaped portion. At least one recess can be provided in the sleeve-shaped portion of the screen support in the direction of the respectively other screen support, that is to say in the longitudinal direction. One end of the resonator and/or a decoupling element as described above can be received in said recess. The recess therefore makes it possible to move the resonator and/or the decoupling element as close as possible to the collar-shaped portion.

The collar-shaped portion of the screen support can provide a sturdy transmission of compressive forces to the pressure rod.

The resonator is actuatable by ultrasound vibrations by means of an ultrasound conductor. The ultrasound conductor can comprise, for example, a circular or a rectangular cross section. It can be guided through a feed-through opening formed in the first screen support, in particular in the collar-shaped portion of the first screen support, into an intermediate region formed between the first screen support and the second screen support. The ultrasound conductor is guided, in a preferred manner, through the feed-through opening without contact such that no ultrasound vibrations are transmitted to the screen support. The guiding of the ultrasound conductor through such a feed-through opening enables the ultrasound conductor to be advantageously realized in a straight manner, as a result of which the ultrasound vibrations are able to be better transmitted to the resonator. As an alternative to this, it is naturally also within the framework of the invention for the ultrasound conductor to be, for example, bent.

The ultrasound conductor can be held via a fastening tube which can be connected directly or indirectly to the collar-shaped portion. On an axial end facing away from the first screen support, the ultrasound conductor can be connected to an ultrasound converter which acts upon it with vibrations, for example by means of a threaded connection. One or multiple sleeves can be arranged between the ultrasound conductor and the fastening tube. Such sleeves can prevent screening material escaping. On an axial end facing the screen support, the fastening tube can be connected to the collar-shaped portion via an intermediate piece. The intermediate piece can be fastened on the collar-shaped portion of the screen support by means of one or multiple screws. For example, the intermediate piece can comprise one or multiple radial continuations with openings, through which screws can be screwed into the collar-shaped portion.

In many exemplary embodiments, the advantage of the named fastening tube is also that, during assembly, it protects a resonator that is already fastened on the screen surface against rotation which could impair or destroy the fastening. In many cases, it is possible in this way, in said exemplary embodiments, to dispense with an anti-rotation safeguard which is described again below.

It is conceivable and is within the framework of the invention for the resonator to extend, for example, in the form of a helix from the first screen support to the second screen support. However, it is preferred when the resonator extends substantially in the longitudinal direction from the first screen support to the second screen support. As a result, the necessary length of the resonator can be reduced. By extending the resonator substantially in the longitudinal direction, the resonator is able to be designed and mounted without curvature in a simpler manner.

It is further advantageous when the resonator is fastened on the screen surface substantially along its entire length. As a result, the ultrasound vibrations can be introduced into the screen surface in an even better manner.

The resonator can be fastened on the screen surface, for example, as a result of bonding or soldering.

The resonator can comprise a rectangular cross section perpendicular to the longitudinal direction. However, it can be advantageous when the resonator comprises a contact surface which is connected to the screen surface, is adapted to the contour of the screen surface and is realized, for example, in a concave manner. This increases the efficiency of the ultrasound conductor also.

In a particularly advantageous manner, the resonator is arranged on an outer side of the screen surface and is fastened there on said screen surface. As a result, the movement of a rotor, which has already been mentioned above and is arranged surrounded by the screen surface, is not obstructed.

In addition, it is advantageous when the screening system includes multiple resonators. In a preferred manner, said multiple resonators are then distributed about the circumference of the screen surface. In particular, they can be distributed uniformly about the circumference of the screen surface. As a result, ultrasound vibrations are able to be introduced into the screen surface in a more uniform manner.

In addition, it is expedient when the screening system includes multiple pressure rods. In a preferred manner, said multiple pressure rods are then distributed uniformly around the circumference of the screen surface. As a result, the compressive forces are able to be transmitted between the two screen surfaces in a uniform manner.

The screening system can additionally include one or multiple ultrasound converters for generating the ultrasound vibrations which are feedable to the ultrasound conductor. It is also within the framework of the invention, in this case, for the ultrasound conductor to include, for connection to one or multiple ultrasound converters, connecting means which do not necessarily have to be a component part of the screening system. The connecting means can be realized, for example, as screw connections.

In order to obtain a screening system which is elongated in the longitudinal direction, the screening system can include (in addition to the above-described first and second screen supports) at least one third substantially annular screen support, at least two screen surfaces which are substantially in the form of lateral cylinder surfaces and at least two resonators for introducing ultrasound vibrations. In the case of said elongated screening system, a first of the screen surfaces is clamped between the first screen support and the second screen support, and a second of the screen surfaces is clamped between the second screen support and the third screen support. At least a first of the resonators is realized for introducing ultrasound vibrations directly into the first screen surface, and at least a second of the resonators is realized for introducing ultrasound vibrations directly into the second screen surface.

The elongated screening system additionally includes a first ultrasound conductor, by means of which the first resonator can be is actuatable by ultrasound vibrations, as well as a second ultrasound conductor, by means of which the second resonator is actuatable by ultrasound vibrations. The first ultrasound conductor is guided through a feed-through opening formed in the first screen support, and the second ultrasound conductor is guided through a first feed-through opening formed in the first screen support and through a second feed-through opening formed in the second screen support. The named feed-through openings can be formed, for example, in a collar-shaped portion of the respective screen support as described above.

The advantage of said embodiment of an elongated screening system is that the ultrasound conductors can be guided through at the same axial position (with reference to a longitudinal direction of the screening system). As a result, it is possible for the first and the second ultrasound conductors to be connected or connectable to a respective ultrasound converter, which can generate ultrasound vibrations and feed the ultrasound conductors, the ultrasound converters being able to be arranged on the same axial end of the screening system. This, in turn, makes it easier to connect the ultrasound converters to one and the same generator. As an alternative to this, it is naturally also conceivable and is within the framework of the invention for the first and the second ultrasound conductors to be connected or connectable to one and the same ultrasound converter.

In a preferred manner, the second ultrasound conductor and the second resonator are offset in relation to the first ultrasound conductor and the first resonator in the circumferential direction with reference to a central axis of the screening system, in particular by an angle within the range of 90° to 270°, in a preferred manner within the range of 120° to 240°, particularly preferred within the range of 150° to 210° and quite particularly preferred by an angle of 180°. As a result, the ultrasound can be transmitted in a particularly advantageous manner to the second screen surface as the first ultrasound conductor and the second ultrasound conductor then influence one another less.

In a preferred manner, the central axes of the screen supports are in alignment. Also in a preferred manner, the screen supports are arranged equidistantly. Additionally preferred, the first and the second cylindrical screen surfaces have identical diameters.

Naturally, it is also within the framework of the invention for the screening system to include more than three screen supports, more than two screen surfaces and more than two resonators with associated ultrasound conductors and, where applicable, ultrasound converters.

In an advantageous embodiment it is provided that at least one resonator comprises at least one first bar-shaped portion with a first end and a second end and comprises at least one second bar-shaped portion with a first end and a second end. In this case, only the first bar-shaped portion, but not also the second bar-shaped portion, is fastened on the screen surface.

However, it is also conceivable for the first bar-shaped portion to be fastened on a first screen surface and the second bar-shaped portion to be fastened on a second screen surface. The first ends of the first bar-shaped portion and of the second bar-shaped portion are connected together, and the second ends of the first bar-shaped portion and of the second bar-shaped portion are connected together.

As a result of such a resonator with two bar-shaped portions, above all bending vibrations, which are known per se, can be introduced into the screen surface. The amplitude of said bending vibrations runs in a radial direction with reference to a central axis of the screening system. Naturally, in addition to the bending vibrations, proportions of other modes of vibration such as, for example, longitudinal vibrations, can be present. The advantage of such a resonator, furthermore, is that the ultrasound can be introduced into the first bar-shaped portion not only at the first end, but also at the second end of the first bar-shaped portion by means of the second bar-shaped portion. A vibration that is more uniform over the length of the bar is generated in the first bar-shaped portion in this way.

In addition, the vibration amplitudes are particularly small at the ends of the first bar-shaped portion. This results in the resonator being fastened on the screen surface in a more reliable manner as a bonded connection, provided for example, becomes detached less easily. In addition, such a resonator is particularly easily adjustable to the frequency that excites it, by, for example, adjusting the length of a slot formed between the first bar-shaped portion and the second bar-shaped portion.

As already explained above, on account of the fastening of the resonator directly on the screen surface, the ultrasound vibrations can be introduced into the screen surface directly from the resonator. The introduction is therefore not effected exclusively indirectly by means of a screen support or another screen frame. Consequently, no ultrasound vibrations have to be introduced into the screen frame. As a result, less ultrasound energy has to be applied in order to introduce the ultrasound vibrations into the screen surface.

In a preferred manner, the resonator is not a component part of a screen frame of the screening system which clamps the screen surface. In this way, the resonator can be decoupled from the screen frame, in particular from low-frequency vibrations which are introduced directly into the screen frame.

In a preferred manner, the resonator, or an ultrasound conductor which acts upon the resonator with ultrasound vibrations, is guided through a feed-through opening formed in a screen frame, in particular in a screen support of the screen frame. The ultrasound conductor is guided without contact through the feed-through opening such that no ultrasound vibrations are transmitted to the screen support.

The named effects are particularly marked when both bar-shaped portions and a central axis of the screening system extend in a common radial plane.

The above-described design of the resonator is not limited to screening systems with annular screen supports, pressure rods and screen surfaces in the form of lateral cylinder surfaces. Rather, such resonators can also be used according to the invention, for example, in screening systems with a flat screen surface.

In addition, in a preferred manner, the screening system includes at least one ultrasound conductor, by means of which the first ends of the first bar-shaped portion and of the second bar-shaped portion is actuatable by ultrasound vibrations. The ultrasound conductor can comprise, for example, a circular or a rectangular cross section. It can be connected to the resonator, for example as a result of screw connection or welding. The resonator can comprise a connecting portion which connects the ultrasound conductor to the first ends of both bar-shaped portions. Said connecting portion can comprise a rectangular cross section.

It is even more preferred when the first ends of the first bar-shaped portion and of the second bar-shaped portion are connected together by means of a first U-shaped portion and the second ends of the first bar-shaped portion and of the second bar-shaped portion are connected together by means of a second U-shaped portion, wherein the first U-shaped portion, the second U-shaped portion and a central axis of the screening system extend in a common radial plane. In an advantageous manner, the first U-shaped portion and consequently the first ends of the bar-shaped portions are actuatable by ultrasound vibrations by means of an ultrasound conductor. The first U-shaped portion transforms a longitudinal vibration of an ultrasound conductor into a bending vibration.

It is also advantageous for such a resonator with two bar-shaped portions to be held on only one of the two screen supports, in particular on a screen support through which the ultrasound conductor is guided into an intermediate region formed between the first screen support and the second screen support.

The direct or indirect fastening of a resonator, of an ultrasound conductor or of a decoupling element on a screen support of a screening system is frequently effected as a result of screw connection. If the resonator is already fastened on the screen surface at the time of the screw connection, said fastening can be impaired or even destroyed by the screw connection.

In order to counter this, a screening system with an anti-rotation safeguard is provided in a further independent aspect of the invention. Said screening system includes at least one screen surface and at least one resonator fastened on the screen surface for introducing ultrasound vibrations directly into the screen surface. Said screening system additionally includes at least one ultrasound conductor, by means of which the resonator is actuatable by ultrasound vibrations. In particular, this can be an above-described screening system.

In said third aspect of the invention, the ultrasound conductor is guided through a feed-through opening formed in a screen support of the screening system and through an anti-rotation protection opening formed in an anti-rotation safeguard. In this case, the anti-rotation protection opening is realized and arranged and aligned to the ultrasound conductor in such a manner that it permits rotation of the ultrasound conductor about its longitudinal axis only within a predetermined angular range. This has the advantageous effect of protecting the fastening of a resonator on the screen surface when the resonator, an ultrasound conductor or a decoupling element are fastened in a direct or indirect manner on the screen support by means of screw connection.

In a preferred manner, the predetermined angular range is smaller than 45°, in a further preferred manner smaller than 20° and in a particularly preferred manner smaller than 10°. In this case, an angular range of 10°, for example, means that the anti-rotation protection opening permits rotation of the ultrasound conductor around a central angular position in both directions of rotation by a maximum of 5°. An angular range that is restricted in such a manner by the anti-rotation protection opening provides sufficient protection of the fastening of the resonator on the screen surface in many cases.

In advantageous designs, the anti-rotation protection includes a plate which comprises the anti-rotation protection opening as well as at least one spacer element which holds the plate at a distance from the feed-through opening, in particular in a direction away from the screen support and toward the screen surface. Such a distance makes it possible for sealing means to be introduced between the plate with the anti-rotation protection opening formed therein and the screen support, said sealing means being able to prevent the screening material passing through the feed-through opening.

In an embodiment which is particularly simple structurally, the ultrasound conductor comprises a non-circular cross section, for example a rectangular cross section, and the anti-rotation protection opening is realized as an elongated hole. The above-named angular ranges, in particular, can be realized as a result.

In particular embodiments, the ultrasound conductor can comprise both a first portion with a circular cross section and a second portion with a non-circular cross section, in particular a rectangular cross section. In this case, the first portion can face an ultrasound converter and be guided through a feed-through opening of a screen support, and the second portion can be guided through the anti-rotation protection opening.

In a preferred manner, the anti-rotation protection opening is open on one side, inwardly in the radial direction with reference to a central axis of the screening system. For example, it can include a circle segment-shaped portion which merges into a slot which widens inwardly in the radial direction and at the end of which the anti-rotation protection opening is open. As a result, during assembly, the anti-rotation safeguard can be displaced inwardly in the radial direction above the ultrasound conductor which, in this case, penetrates through the slot partially into the circular portion. The slot can widen inwardly in the radial direction. This can contribute to the fact that the ultrasound conductor is rotatable within a predetermined angular range.

If such an anti-rotation safeguard is present, in many cases it is possible to dispense with the previously described decoupling elements and fastening tubes.

In advantageous designs which are independent of the above aspects, at least one and in a preferred manner both screen supports comprise a groove which runs in the circumferential direction and into which an elastic sealing ring, in particular an elastic O-ring seal, is inserted which protrudes outwardly beyond the groove in the radial direction. The screen surface can be clamped in the radial direction by means of said sealing ring. In this way, the screen surface is able to be clamped in a homogeneous manner not only in the axial direction but also in the radial direction. This allows the ultrasound to be introduced into the screen surface in a more homogeneous manner, which, in turn, enables higher throughput.

In an advantageous manner, at least one and in a preferred manner both screen supports comprise a sleeve-shaped portion, on the radial outer side of which the groove is formed. In the case of said arrangement, the sealing ring can be held in a particularly secure manner on the screen support. A collar-shaped portion, as described above, can protrude radially outwardly from the sleeve-shaped portion.

The groove can be arranged on an axial end of the sleeve-shaped portion facing the respectively other screen support and an axial end of the screen surface can be held by means of a hose clip on an axial end of the sleeve-shaped portion facing away from the other screen support. Using such a hose clip, the screen surface can be clamped particularly well in the axial direction by means of the sealing ring such that said sealing ring, in turn, can provide tension in the radial direction.

In the axial direction, the groove can be delimited on a side facing away from the respectively other screen support by a first axial delimiting surface and on a side facing the respectively other screen support by a second axial delimiting surface, wherein the first delimiting surface has a larger extent than the second delimiting surface in the radial direction. This facilitates the insertion of the sealing ring into the groove. When the screen surface is clamped away from the respectively other screen support in the axial direction by means of a hose clip, the sealing ring is prevented from slipping out of the groove.

In a preferred manner, a sleeve-shaped continuation, which extends from the sleeve-shaped portion of the screen support in the direction of the respectively other screen support, can be provided to form the groove. The sleeve-shaped continuation can be realized in a thinner manner in the radial direction than the sleeve-shaped portion, but it can run flush with the sleeve-shaped portion on a radial inner side. A thickening can extend radially outwardly from the end of the sleeve-shaped continuation. The groove can then be formed by an end face of the sleeve-shaped portion, by the sleeve-shaped continuation and by the thickening. In this case, in a preferred manner, the thickening has a radial extent which is smaller than a radial extent of the named end face.

The groove can be milled, for example, into the screen support, in particular into the sleeve-shaped portion thereof. The sealing ring can consist, for example, of rubber.

A further aspect of the invention relates to an eddy-current screening machine, which includes at least one screening system according to the invention as described above. Said eddy-current screening machine can include a rotor which is arranged in an interior surrounded by the screen surface. By means of such a rotor, screening material situated in the interior can be excited to form an eddy current, as a result of which fine material can be conveyed outward through the screen surface, whilst coarse material can be conveyed to a coarse material outlet arranged on the end of the screen surface. The screening system can be aligned, for example, inside the eddy-current screening machine such that its longitudinal direction extends in the horizontal or vertical direction.

The eddy-current screening machine can include one or multiple ultrasound converters for generating the ultrasound vibrations which are feedable to the ultrasound conductor.

In addition, the invention also relates to the use of an above-described screening system according to the invention, or to an eddy-current screening machine according to the invention as described above for control-screening, separating, loosening, recovering or fractionating screening material.

Figure 2:
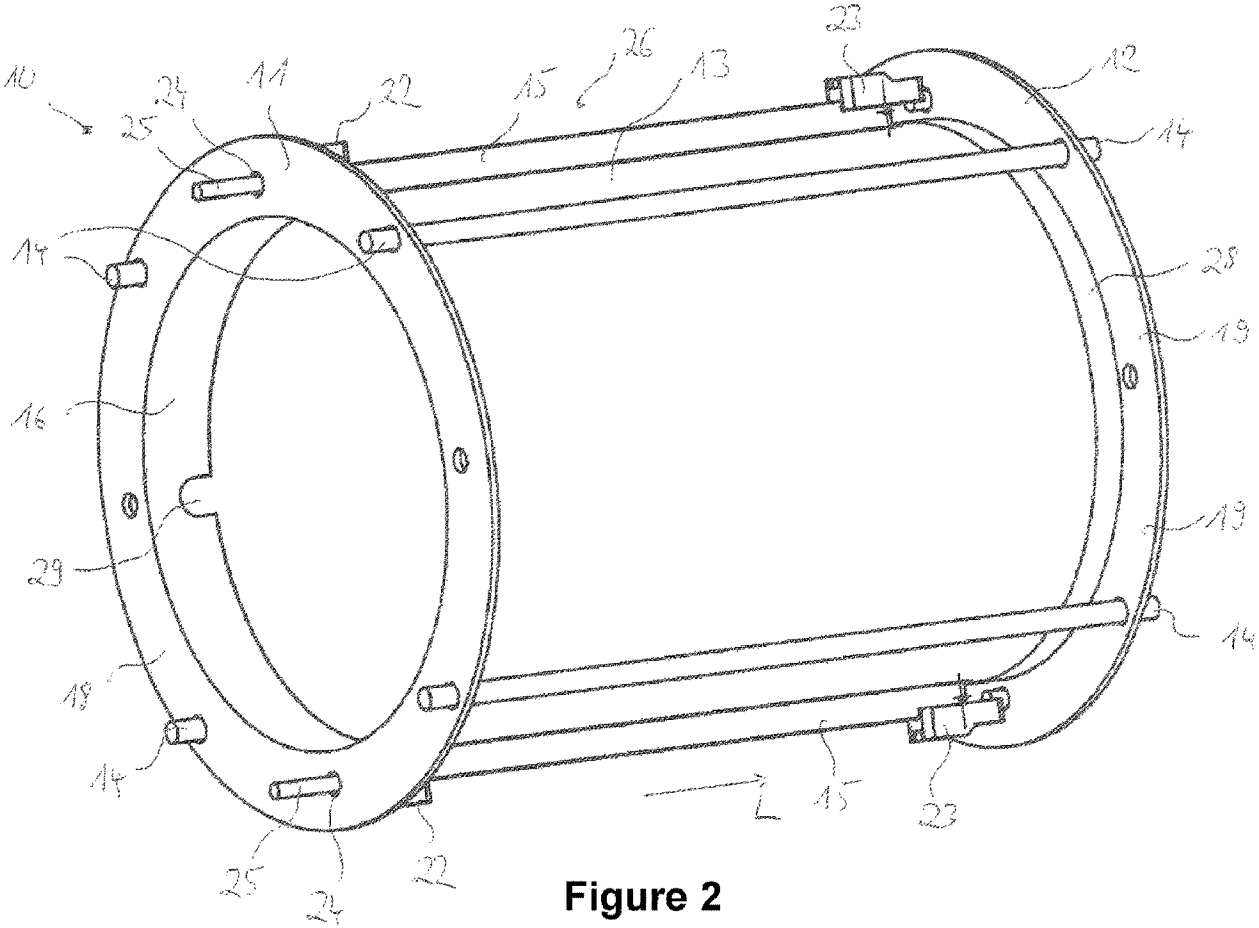
Figure 3B:
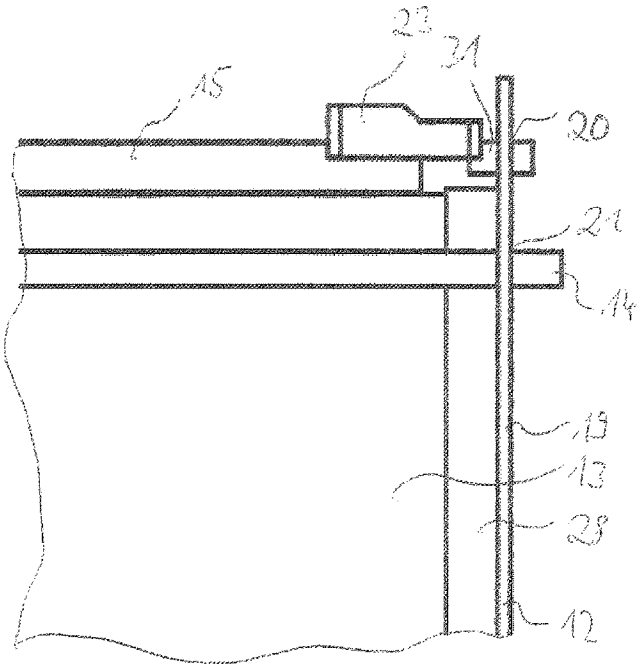
Figure 3A:
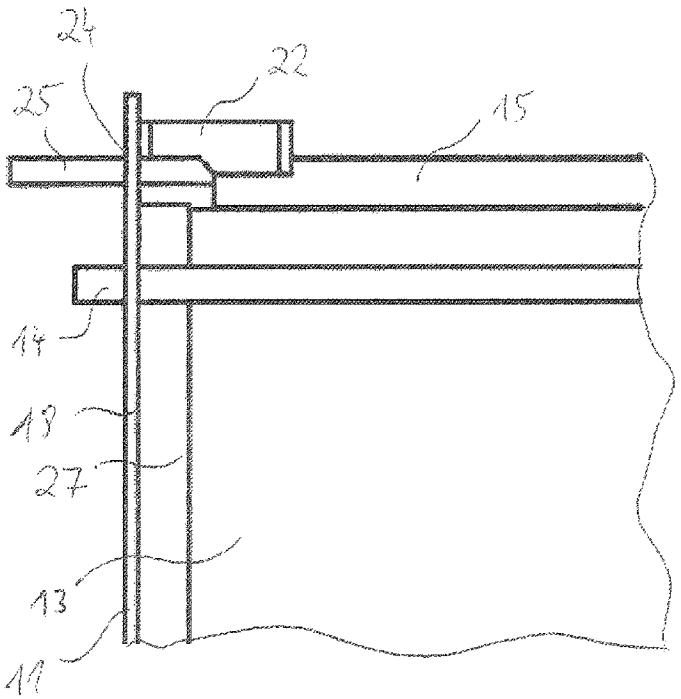

The invention is explained in detail below by way of exemplary embodiments and several drawings, in which FIG. 1: shows a first perspective view of a first screening system according to the invention, but without a screen surface;

FIG. 2: shows a second perspective view of the screening system according to FIG. 1 with a screen surface;

FIG. 3*a*: shows a detail of a side view of part of a first screen support of the screening system and of a first decoupling element according to FIGS. 1 and 2;

FIG. 3*b*: shows a detail of a side view of part of a second screen support of the screening system and of a second decoupling element according to FIGS. 1 to 3*a;*

Figure 4B:
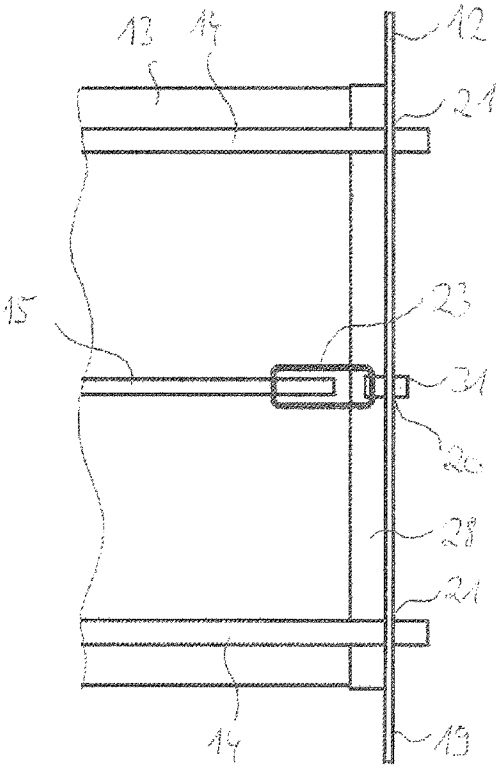
Figure 4A:
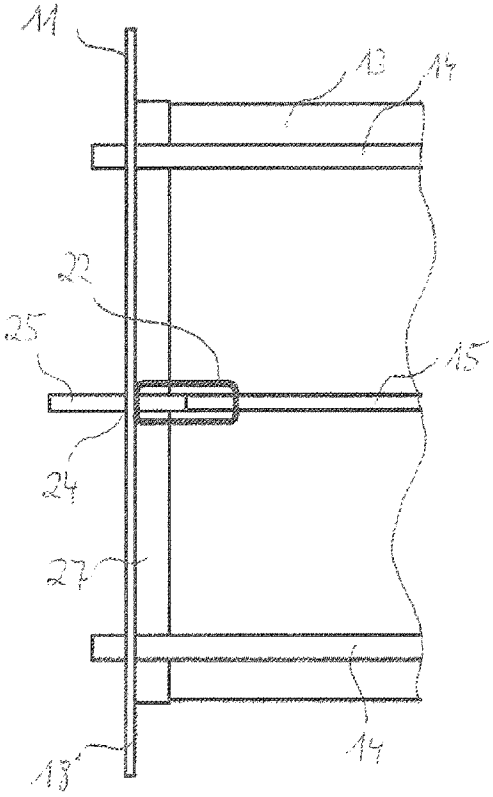

FIG. 4*a*: shows a detail of a top view of part of the first screen support and of the first decoupling element according to FIGS. 1 to 3*b;*

FIG. 4*b*: shows a detail of a top view of part of the second screen support and of the second decoupling element according to FIGS. 1 to 4*a;*

Figure 5A:
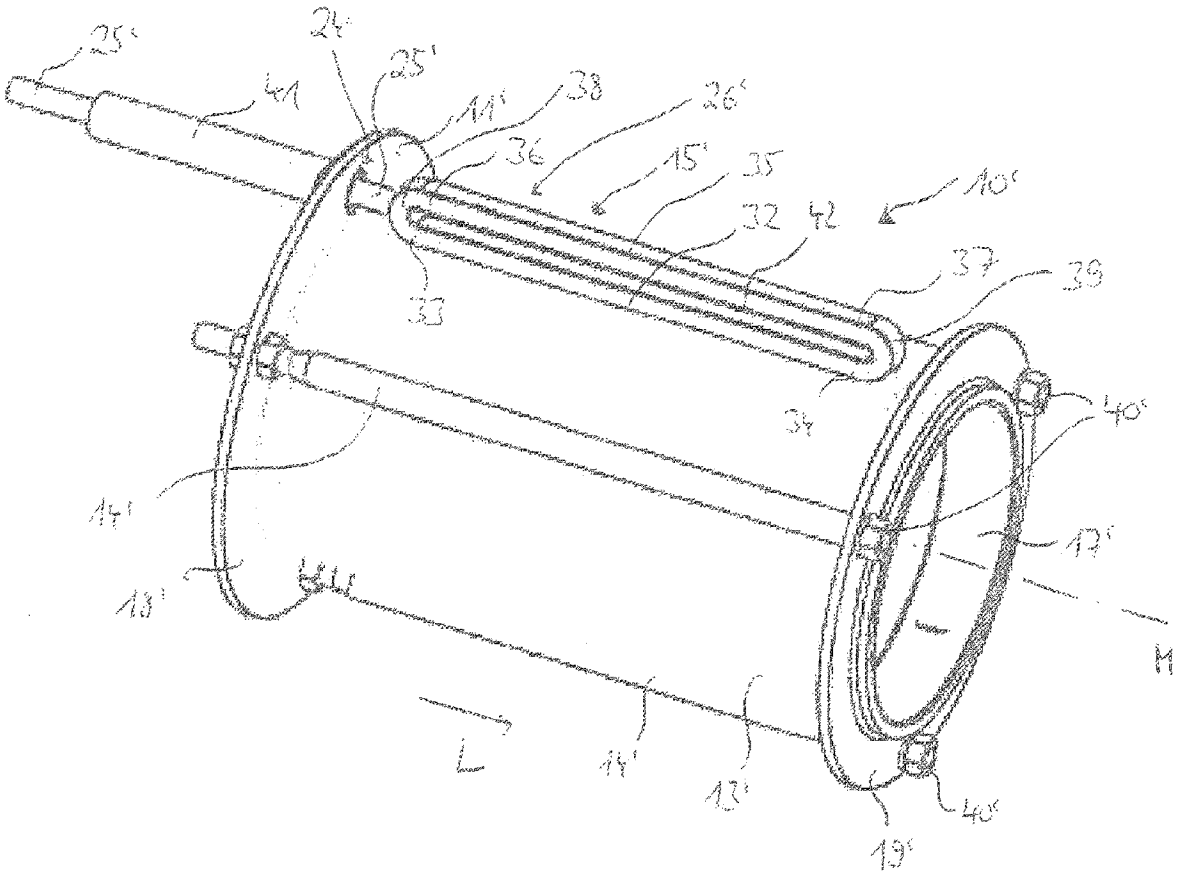
Figure 5B:
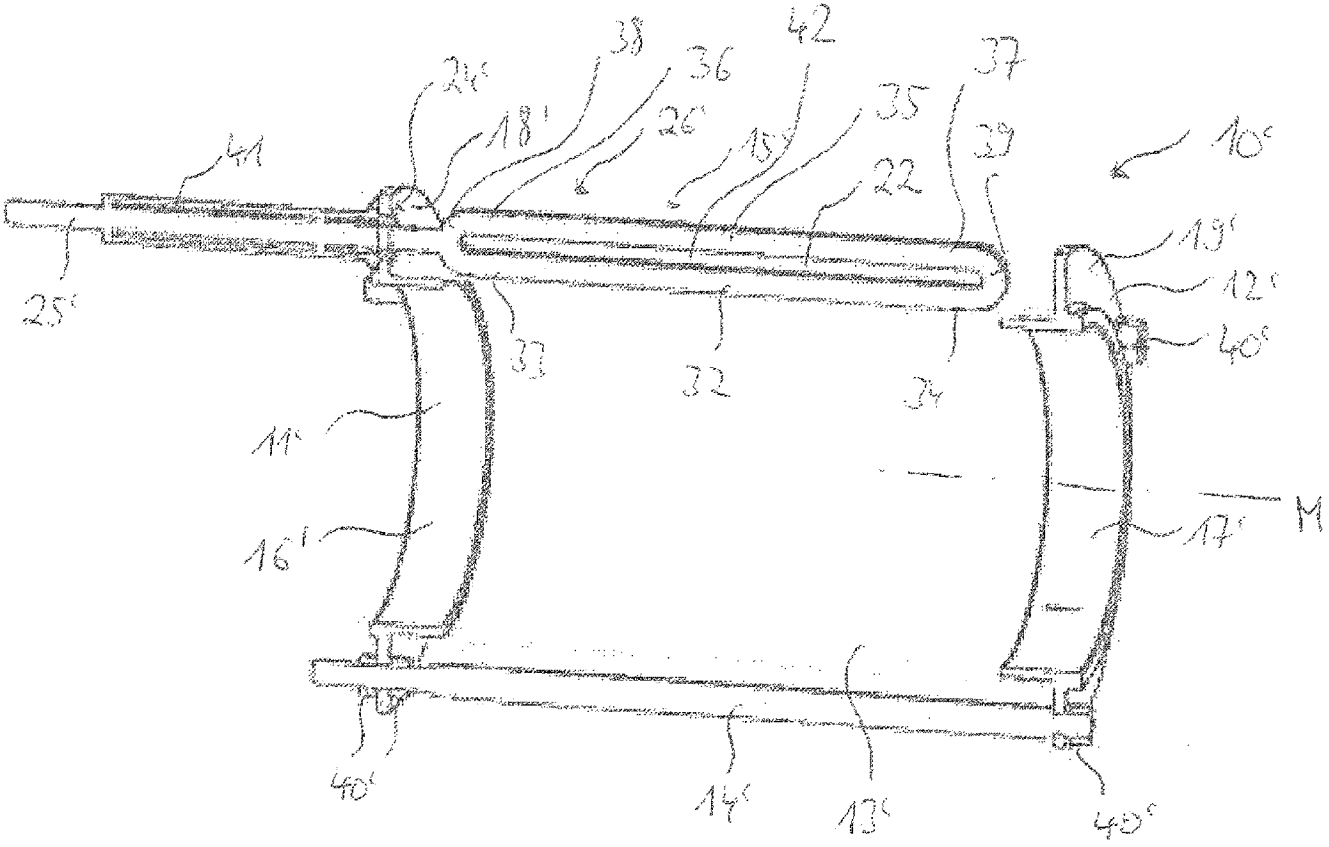
Figure 6:
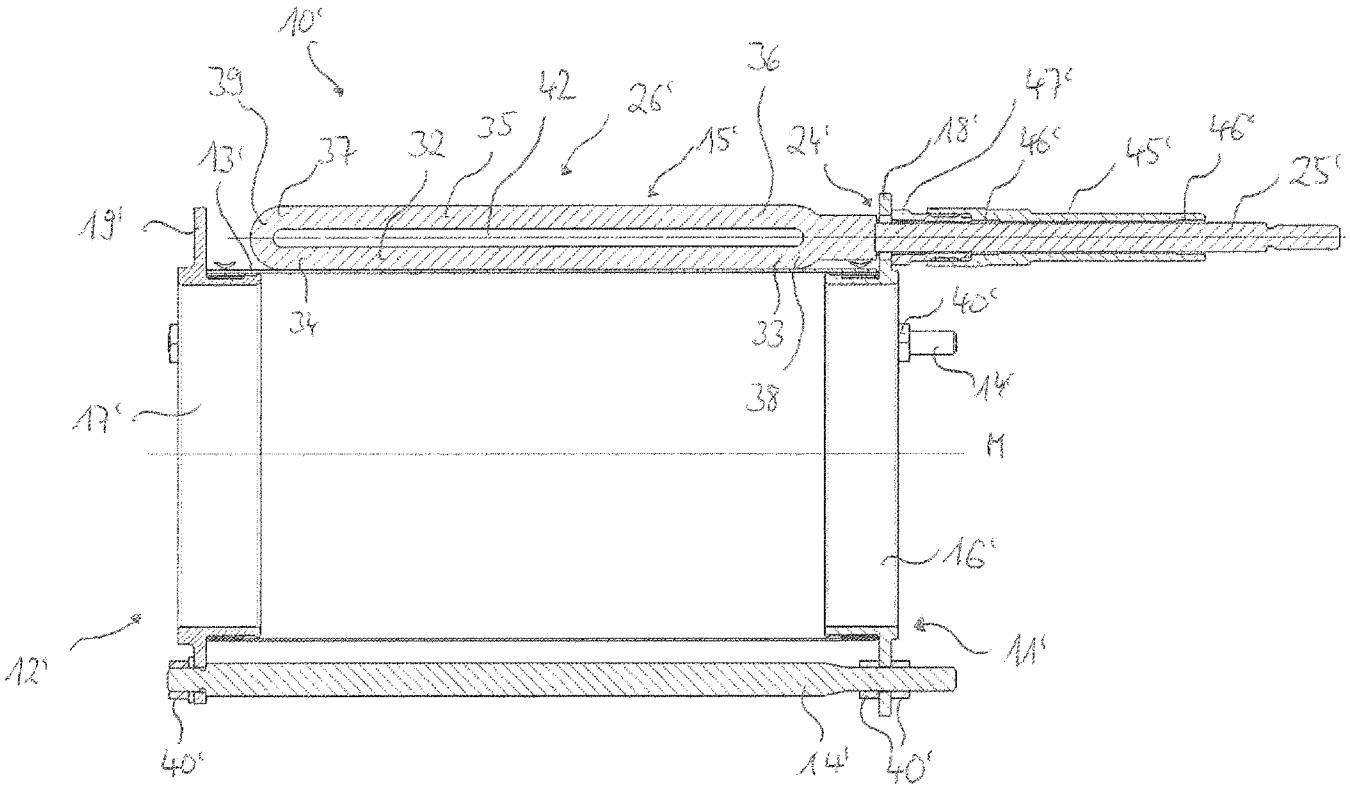

FIG. 5*a*: shows a perspective view of a second screening system according to the invention;

FIG. 5*b*: shows a perspective sectional view of the second screening system according to the invention;

FIG. 6: shows a side sectional view through the second screening system according to the invention according to FIGS. 5*a* and 5*b;*

Figure 7:
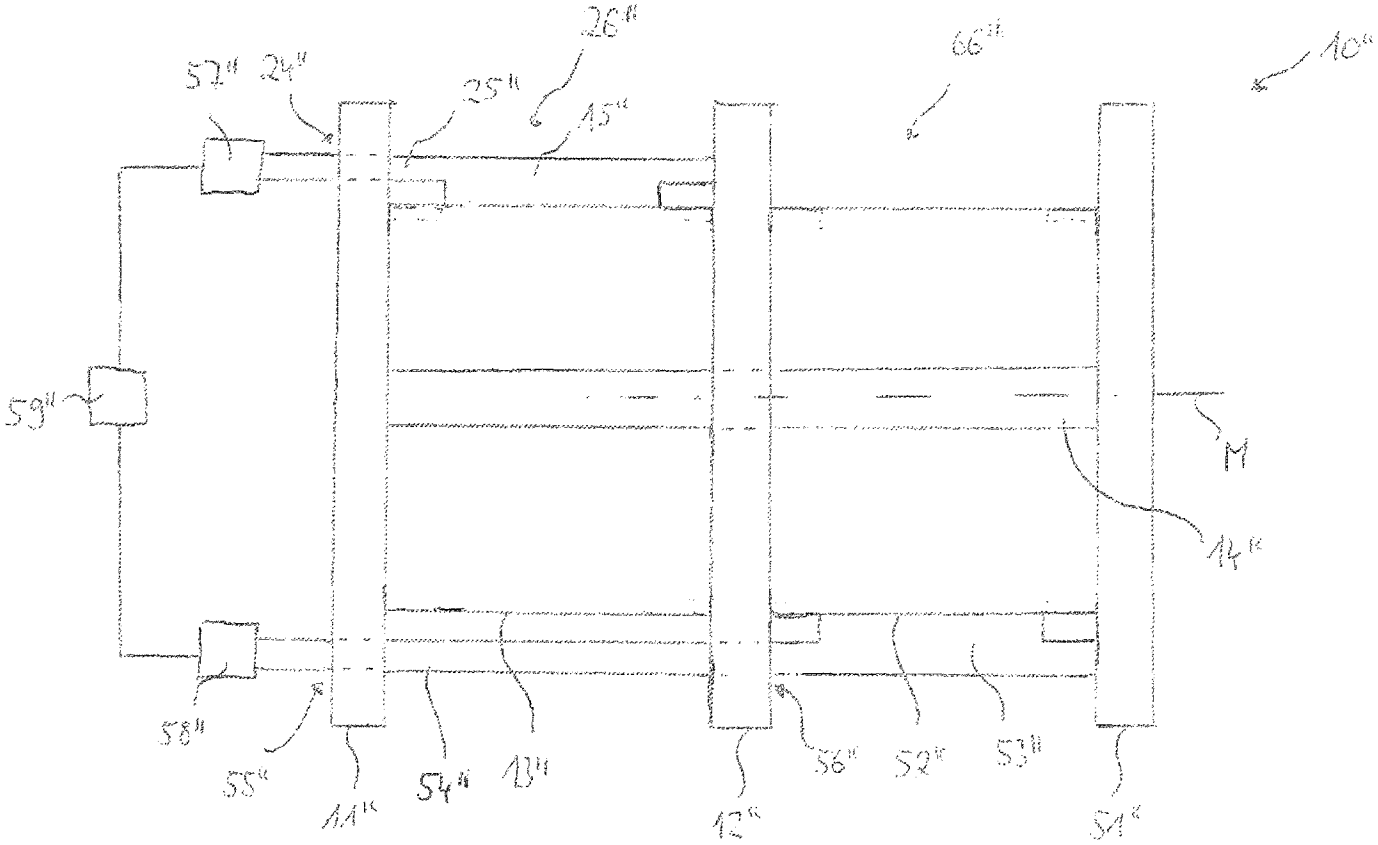
Figure 8:
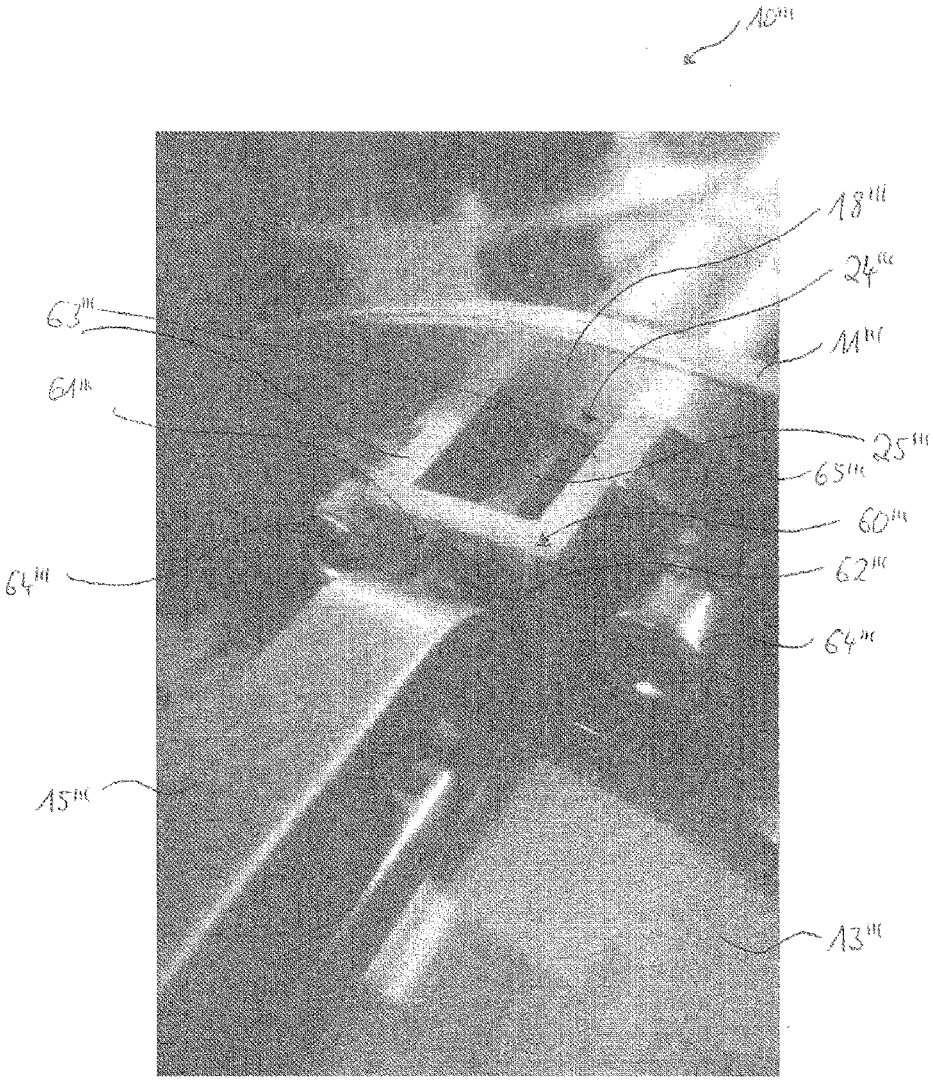
Figure 9A:
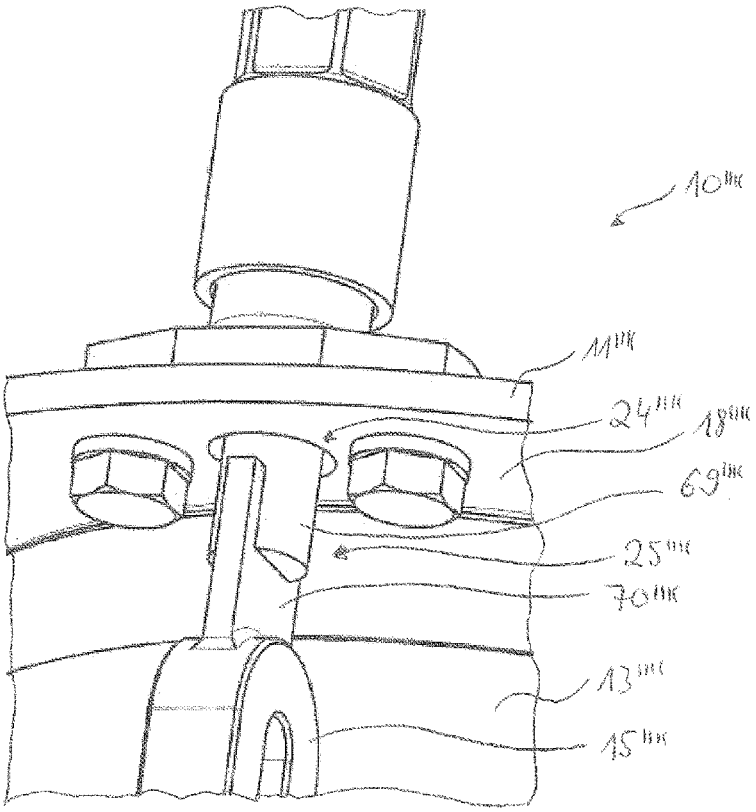
Figure 9B:
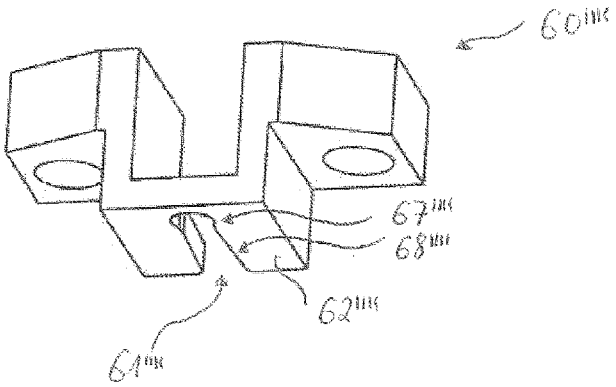
Figure 9C:
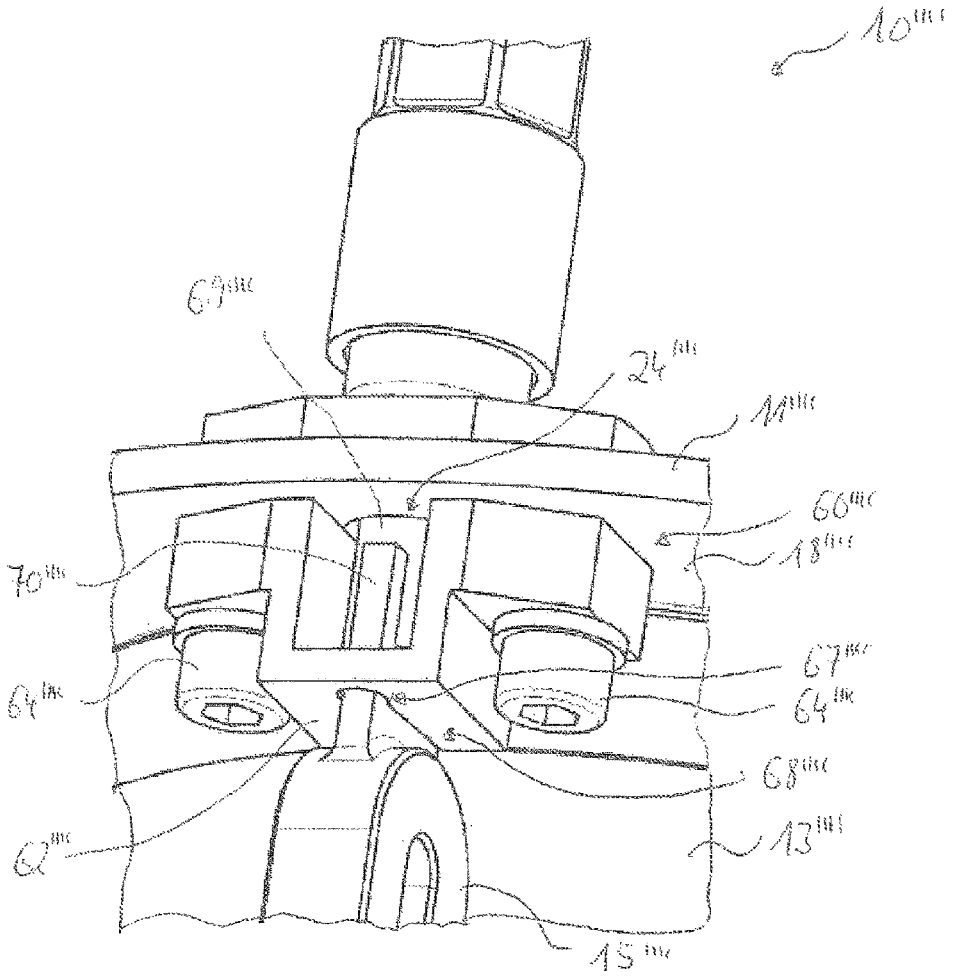

FIG. 7: shows an outlined side view of a third elongated screening system according to the invention with three screen supports, two screen surfaces, two resonators and two ultrasound conductors;

FIG. 8: shows a photo of a detail of a fourth screening system according to the invention with anti-rotation safeguard;

FIG. 9*a*: shows a perspective view of a detail of a fifth screening system according to the invention, but without anti-rotation safeguard;

FIG. 9*b*: shows a perspective view of the anti-rotation safeguard of the fifth screening system according to the invention;

FIG. 9*c*: shows a perspective view of a detail of the fifth screening system according to the invention with anti-rotation safeguard according to FIG. 9*b;*

Figure 10A:
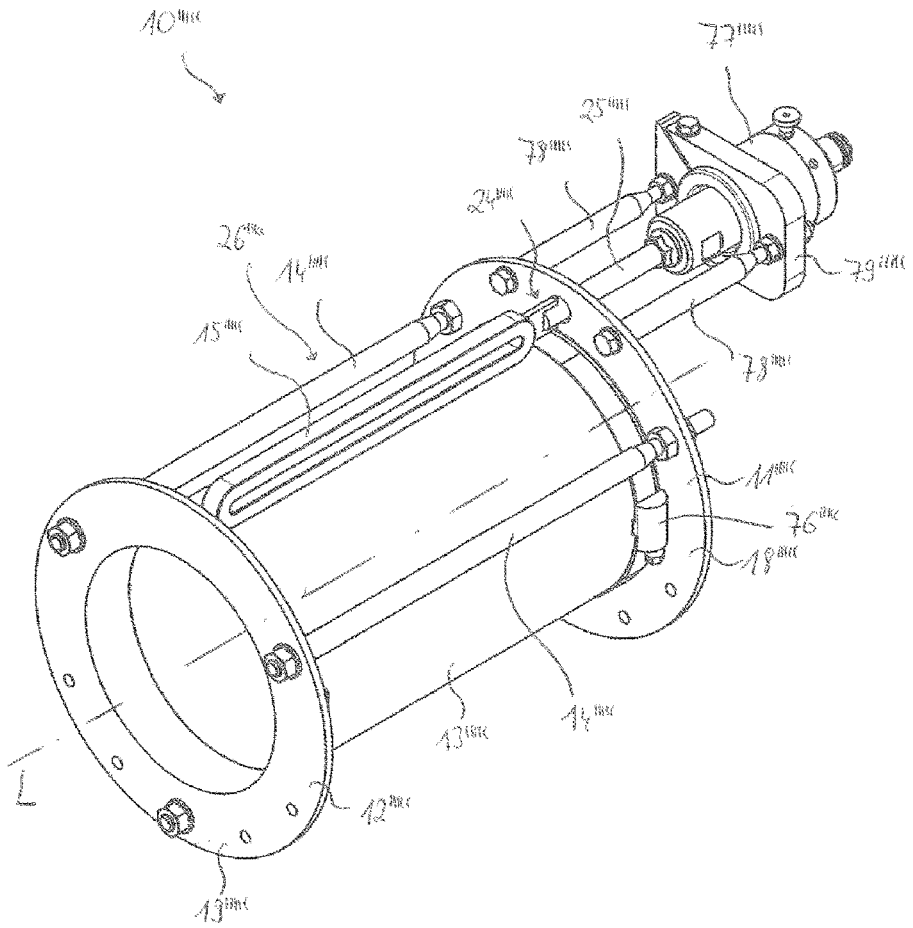
Figure 10B:
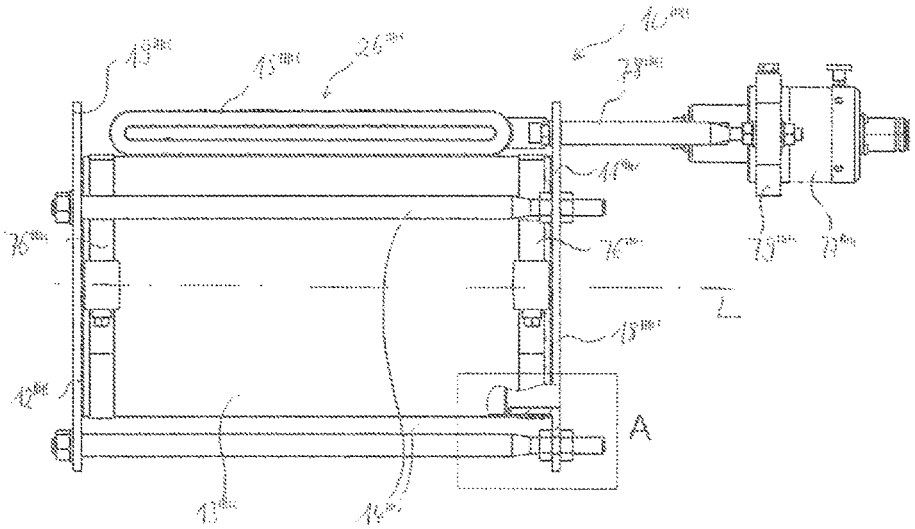

FIG. 10*a*: shows a perspective view of a sixth screening system according to the invention with a groove and an O-ring seal;

FIG. 10*b*: shows a side view of the sixth screening system according to the invention according to FIG. 10*a;*

Figure 10C:
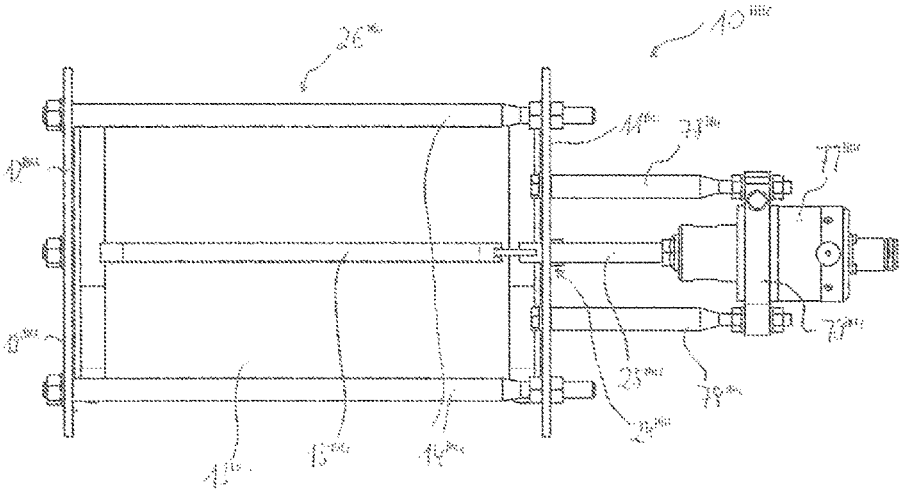

FIG. 10*c*: shows a top view of the sixth screening system according to the invention according to FIGS. 10*a* and 10*b;*

Figure 10D:
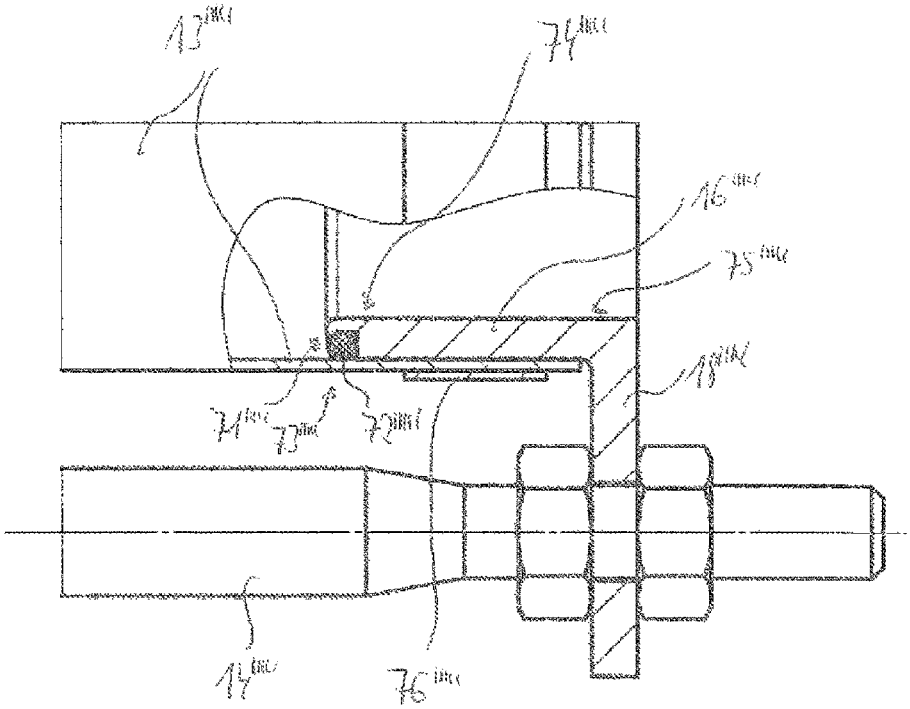

FIG. 10*d*: shows an enlarged view of the detail A from FIG. 10*b;*

Figure 11A:
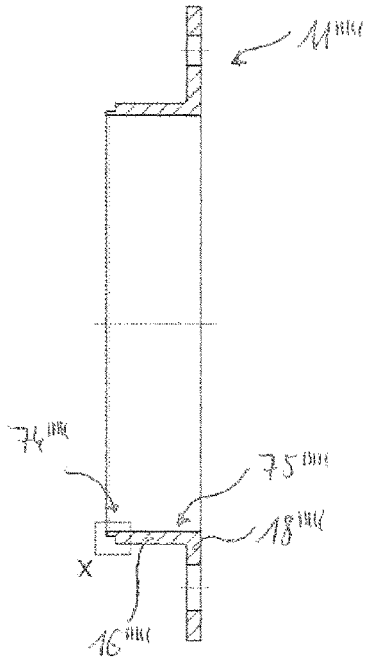
Figure 11B:
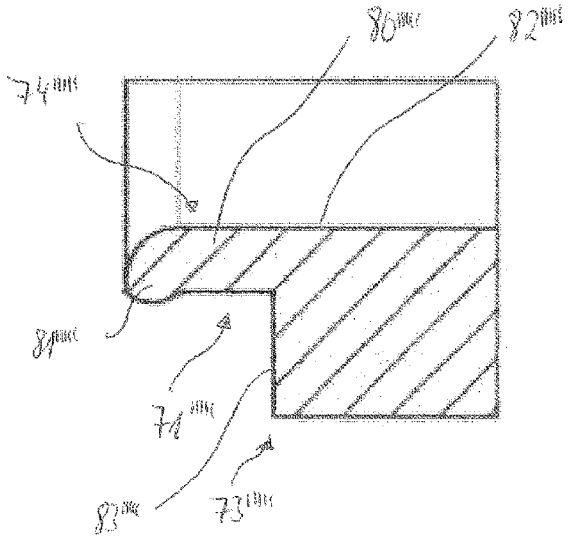

FIG. 11*a*: shows a side sectional view of a screen support of the sixth screening system according to the invention;

FIG. 11*b*: shows an enlarged view of the detail X from FIG. 11*a*.

The screening system 10 shown in FIG. 1 includes a first annular screen support 11 and a second circular ring-shaped screen support 12, both of which are designed identically to one another. In other embodiments not shown here, however, it is also conceivable for the two screen supports 11, 12 not to be designed identically to one another. A screen surface 13, which is in the form of a circular lateral cylinder surface and extends in a longitudinal direction L, can be clamped between the screen supports 11, 12; said screen surface 13, however, is better illustrated firstly in FIG. 2. Each of the two screen supports 11, 12 comprises in each case a sleeve-shaped portion 16 or 17 as well as a collar-shaped portion 18 or 19 which protrudes radially outward from the sleeve-shaped portion 16 or 17.

For fastening the screen surface 13 on the outer side of the sleeve-shaped portions 16, 17 and tensioning the screen surface 13 axially, a respective clamping ring 27, 28 is provided on both screen supports 11, 12, of which only the clamping ring 28 arranged on the second screen support 12 is visible here. The sleeve-shaped portions 16, 17 additionally have in each case four recesses 29 or 30, which are distributed uniformly in the circumferential direction and extend in the direction of the respectively other screen support 11, 12, that is to say also in the longitudinal direction L.

Four pressure rods 14, which are distributed uniformly in the circumferential direction and extend along the longitudinal direction L from the first screen support 11 to the second screen support 12, are fastened on the collar-shaped portions 18, 19. In this case, the pressure rods 14 are fastened on the first screen support 11 as a result of welding or screw connection and are connected to the second screen support 12 by means of a clamping device which is as described above. In this way, the pressure rods 14 brace the screen supports 11, 12 together in such a manner that compressive stress is generated between the screen supports 11, 12.

Two hollow-profile-shaped resonators 15 which have a rectangular cross section, are diametrally opposed and consequently uniformly distributed in the circumferential direction, additionally extend along the longitudinal direction L from the first screen support 11 to the second screen support 12. The resonators 15 can consist, for example, of chrome steel or plastics material.

The resonators 15 comprise in each case a first and a second vibration node. At the first vibration node, the resonators 15 are held on the first screen support 11 by means of a respective first decoupling element 22, and at the second vibration node they are held on the second screen support 12 by means of a respective second decoupling element 23. The ends of the resonators 15 are received in the recesses 29, 30 of the sleeve-shaped portion 16, 17.

Four feed-through openings 24, which are distributed uniformly in the circumferential direction, are formed in the collar-shaped portion 18 of the first screen support 11. An ultrasound conductor 25 extends in each case through two oppositely situated feed-through openings of said feed-through openings 24 into an intermediate region 26 of the screening system 10 formed between the first screen support 11 and the second screen support 12. The ultrasound conductors 25 are guided through the feed-through openings 24 without contact such that no ultrasound vibrations are transmitted directly on the first screen support 11. They extend parallel to the longitudinal direction L of the screening system 10 and comprise a circular cross section.

The screening system 10 can additionally include one or multiple ultrasound converters, not shown here, for generating the ultrasound vibrations which are feedable to the ultrasound conductors 25 and then to the resonators 15. The at least one ultrasound converter can be connected to the ultrasound conductors 25, for example, by a screw connection.

FIG. 2 shows the entire screening system 10 with screen surface 13. The screen surface 13 is realized as a screen fabric and is produced as one entity of sections which all run parallel to the longitudinal direction L. In the longitudinal direction L, the screen surface 13 can comprise a length of within the range of between 100 mm and 1000 mm and a diameter of within the range of between 100 mm and 500 mm. It is fastened on the outer side of the sleeve-shaped portion 17, not shown here, of the second screen support 12 by means of the clamping ring 28. In addition, the screen surface 13 can also be bonded on the outer side of the sleeve-shaped portion 17. Other types of fastening of the screen surface 13, not shown here, are however also conceivable.

The resonators 15 are fastened on the outer side of the screen surface 13 along their entire length as a result of bonding. Ultrasound vibrations can be introduced into the screen surface 13 by means of the two resonators 15. On account of the elongated realization of the resonators 15, they enable the generation of ultrasound vibrations which comprise substantially only a component in the longitudinal direction L of the screening system. The fastening of the resonators 15 along their entire length allows sound to be introduced into the screen surface 13 in a particularly effective manner.

FIG. 3*a* shows a detailed side view for fastening the pressure rods 14 and the resonators 15 on the first screen support 11. As already mentioned, the ultrasound conductor 25 is guided through the feed-through opening 24 formed in the collar-shaped portion 18 without contact. The ultrasound conductor 25 is connected to the end face of the resonator 15 in order to be able to transmit ultrasound vibrations to said resonator. In a first vibration node, the resonator 15 is held on the collar-shaped portion 18 by means of the first decoupling element 22. The first decoupling element 22 is fixedly connected to the collar-shaped portion 18, for example by means of a weld connection. FIG. 4*a* shows a top view of substantially the same cutout. All in all, as a result of said design, ultrasound vibrations can only be transmitted to the resonator 15, not however also to the first screen support 11. No ultrasound vibration of the first screen support 11 is generated that is not necessary for the actual purpose of screening.

The fastening on the second screen support 12 is developed in a different manner, as is produced from the views of details in FIGS. 3*b* and 4*b*. Here, namely, the second decoupling element 23 is not fixedly connected to the sleeve-shaped portion 19. Instead of which, a clamping device is present. Said clamping device includes a clamping element 31 which is provided with an external thread and is fixedly connected to the second decoupling element 23. A bore 20 is provided in the sleeve-shaped portion 19 of the second screen support 12. As a result of interaction between the external thread and the bore 20 and two clamping nuts, not shown here, the clamping element 31 and consequently also the resonator 15 can be fastened and braced on the sleeve-shaped portion 19 of the second screen support 12. In a similar manner, the pressure rod 14 can be fastened and braced in a bore 21 by means of a clamping device, not shown here in any detail. FIG. 4*b* shows a top view of the substantially identical cutout.

Even during assembly, the decoupling elements 22, 23 protect the resonator 15, which is already fastened on the screen surface 13, against rotation, which could impair or destroy the fastening. In this way, it is possible in this exemplary embodiment to dispense with an anti-rotation safeguard shown in FIG. 8.

The screening system 10 shown in FIGS. 1 to 4*b* can be used in an eddy-current screening machine, for example for control-screening, separating, loosening, recovering or fractionating screening material. For this purpose, the eddy-current screening machine can include a rotor which is arranged in an interior surrounded by the screen surface 13. By means of such a rotor, screening material situated in the interior can be excited to form an eddy current, as a result of which fine material can be conveyed outwardly through the screen surface 13, whilst coarse material can be conveyed to a coarse material outlet arranged on the end of the screen surface.

The second screening system 10' according to the invention shown in FIGS. 5*a* and 5*b* also includes a first annular screen support 11' and a second circular ring-shaped screen support 12', both of which are designed in a substantially mirrored manner with respect to one another. A screen surface 13', which is in the form of a circular lateral cylinder surface and extends in a longitudinal direction L, is clamped between the screen supports 11', 12'. The first screen support 11' comprises a sleeve-shaped portion 16' which can only be seen in FIG. 5*b* and a collar-shaped portion 18' which protrudes radially outwardly from the sleeve-shaped portion 16'. In an analogous manner, the second screen support 12' comprises a sleeve-shaped portion 17' and a collar-shaped portion 19' which protrudes radially outwardly from the sleeve-shaped portion 17'.

In the case of this embodiment also, a respective clamping ring is provided for fastening the screen surface 13' on the outer side of the sleeve-shaped portions on both screen supports 11', 12'. In contrast to the first exemplary embodiment according to FIGS. 1 to 4*b*, the sleeve-shaped portions here, however, do not include any recesses which extend in the direction of the respectively other screen support.

Three pressure rods 14', which are distributed uniformly in the circumferential direction and extend along the longitudinal direction L from the first screen support 11' to the second screen support 12', are fastened on the collar-shaped portions 18', 19', only two of which, however, can be seen. The pressure rods 14' are fastened on the screen supports 11', 12' by means of clamping nuts 40'.

In addition, a resonator 15', which can consist, for example, of chrome steel or plastics material, extends along the longitudinal direction L from the first screen support 11' substantially to the second screen support 12'. Said resonator 15' comprises a first bar-shaped portion 32 with a first end 33 and a second end 34 and a second bar-shaped portion 35 with a first end 36 and a second end 37. Only the first bar-shaped portion 32, but not also the second bar-shaped portion 35, is fastened on the outer side of the screen surface 13' by means of bonding. The first ends 33, 36 of the first bar-shaped portion 32 and of the second bar-shaped portion 35 are connected together by means of a first U-shaped portion 38, and the second ends 34, 37 of the first bar-shaped portion 32 and of the second bar-shaped portion 35 are connected together by means of a second U-shaped portion 39. The two bar-shaped portions 32, 35, the two U-shaped portions 38, 39 and a central axis M of the screening system 10' extend in a common radial plane.

As can be seen from the side sectional view in FIG. 6, a feed-through opening 24', through which an ultrasound conductor 25' with a circular cross section extends into an intermediate region 26' of the screening system 10' formed between the first screen support 11' and the second screen support 12', is formed in the collar-shaped portion 18' of the first screen support 11'. The ultrasound conductor 25' is held on the collar-shaped portion 18' by means of a fastening tube 45'. On an axial end facing away from the first screen support 11' (not shown on the right in FIG. 6), the ultrasound conductor 25' is fastened on an ultrasound converter, not shown, by means of an indicated thread. Sleeves 46' between fastening tube 45' and ultrasound conductor 25' prevent screening material from escaping. On an axial end facing the first screen support 11' (on the left in FIG. 6), the fastening tube 45' is connected to the collar-shaped portion 18' by means of an intermediate piece 47'. The intermediate piece 47' includes radial continuations, not visible in FIG. 6, with openings, through which screws can be screwed into the collar-shaped portion 18'. In this way, the ultrasound conductor 25' is mounted so as to slide in the axial direction inside the fastening tube 45' and the sleeves 46'.

The fastening tube 45' protects, also during assembly, the resonator 15', which is already fastened on the screen surface 13', against rotation, which could impair or destroy the fastening. In this way, it is possible in this exemplary embodiment also to dispense with an anti-rotation safeguard shown in FIG. 8.

By means of the ultrasound conductor 25', the first U-shaped portion 38 and consequently the first ends 33, 36 of the bar-shaped portions 32, 25 are actuatable by ultrasound vibrations. Bending vibrations, above all, can be introduced into the screen surface 13' by the resonator 15', in a radial direction with reference to the central axis M of the screening system 10'. The transformation of a longitudinal vibration of an ultrasound conductor into a bending vibration, in this case, is performed by the first U-shaped portion 38. Naturally, in addition to the bending vibrations, proportions of other modes of vibration such as, for example, longitudinal vibrations, can also be present. The advantage of such a resonator 15', furthermore, is that the ultrasound can be introduced into the first bar-shaped portion 32 not only at the first end 33, but also at the second end 34 of the first bar-shaped portion 32 by means of the second bar-shaped portion 35 and the second U-shaped portion 39. A vibration that is more uniform over the length of the bar is generated in the first bar-shaped portion 32 in this way.

The vibration amplitudes are particularly small on the first end 33 and on the second end 34 of the first bar-shaped portion 32. This results in the resonator 15' being fastened in a more reliable manner on the screen surface 13' as the bonded connection becomes detached less easily. In addition, the resonator 15' is adjustable to the frequency that excites it in a particular simple manner, for example, by adjusting the length of a slot 42 formed between the first bar-shaped portion 32 and the second U-shaped portion 32.

FIG. 7 shows a third screening system 10" according to the invention which is realized as an elongated screening system. Said screening system includes a first substantially annular screen support 11", a second substantially annular screen support 12" and a third substantially annular screen support 51", the central axes M of which coincide and which are arranged in an equidistant manner. In addition, the screening system includes two pressure rods 14", only one of which can be seen here. Said pressure rods 14" brace the screen supports 11", 12", 51" together in such a manner that compressive stress is generated between the screen supports 11", 12", 51". The pressure rods 14" can extend from the first screen support 11" through the second screen support 12" to the third screen support 51". As an alternative to this, it is also conceivable for first pressure rods 14" to extend only from the first screen support 1" to the second screen support 12" and for second pressure rods 14" to extend only from the second screen support 12" to the third screen support 51". The pressure rods 14" can be fastened on the screen supports 11", 12", 51", for example, as shown in FIGS. 1 to 6.

The screening system 10" additionally includes a first screen surface 13" which is substantially in the form of a lateral cylinder surface and is clamped between the first screen support 11" and the second screen support 12", as well as a second screen surface 52" which is substantially in the form of a lateral cylinder surface and is clamped between the second screen support 12" and the third screen support 51". The clamping of the screen surfaces 13", 52" is effected as in the previously described exemplary embodiments. In addition, the screening system 10" includes a first resonator 15" for introducing ultrasound vibrations directly into the first screen surface 13" and a second resonator 53" for introducing ultrasound vibrations directly into the second screen surface 52". The first resonator 15" is actuatable by ultrasound vibrations by means of a first ultrasound conductor 25" and the second resonator 53" are actuatable by with ultrasound vibrations by means of a second ultrasound conductor 54".

The first ultrasound conductor 25" is guided through a feed-through opening 24" formed in the first screen support 11" into a first intermediate region 26" formed between the first screen support 11" and the second screen support 12". The second ultrasound conductor 54" is guided through a first feed-through opening 55" formed in the first screen support 11" and through a second feed-through opening 56" formed in the second screen support 12" into a second intermediate region 66" formed between the second screen support 12" and the third screen support 51". The second ultrasound conductor 54" and the second resonator 53" are offset by 180° in the circumferential direction with reference to the central axis M of the screening system 10" in relation to the first ultrasound conductor 25" and the first resonator 15", and are therefore diametrally opposed to one another. In this way, the ultrasound conductors 25", 54" have particularly little influence on one another. The ultrasound conductors 25", 54", similarly to as shown in FIGS. 1 to 6, can be held on the screen supports 11", 12", 51" by means of decoupling elements or fastening tubes which are not shown here. As an alternative to this or in addition to it, anti-rotation safeguard can also be provided, as shown in FIG. 8 and described below.

The first ultrasound conductor 25" is connected to a first ultrasound converter 57" and the second ultrasound conductor 54" is connected to a second ultrasound converter 58". The first ultrasound converter 57" and the second ultrasound converter 58" are connected to one and the same generator 59". As an alternative to this, it is naturally also conceivable for both ultrasound conductors 25", 54" to be connected to one and the same ultrasound converter.

A particularly space-saving arrangement for the elongated screening system 10" is produced in said embodiment as, amongst other things, the ultrasound conductors 25", 54" can be guided through at the same axial position (with reference to a longitudinal direction of the screening system 10").

FIG. 8 shows a photo of a detail of a fourth screening system 10'" according to the invention. This is also a screening system 10'" with two substantially annular screen supports (only a first screen surface 11'" of which can be seen here), a screen surface 13'" in the form of a lateral cylinder surface and a resonator 15'" which is realized similarly to the resonator 15" shown in FIGS. 5*a* to 6 and is fastened directly on the screen surface 13'". The screening system 10'" includes an ultrasound conductor 25'", by means of which the resonator 15'" is actuatable by ultrasound vibrations. The ultrasound conductor 25'" comprises a rectangular cross section and is guided through a feed-through opening 24'" which is formed in a collar-shaped portion 18'" of the first screen support 11'".

The screening system 10'" additionally includes an anti-rotation safeguard 60'". Said anti-rotation safeguard comprises a plate 62'" which is held at a distance from the feed-through opening 24'" by means of two spacer elements 63'", in the direction away from the first screen support 11'" and toward the screen surface 13'". Radial continuations 65'", which are fastened on the collar-shaped portion 18'" of the first screen support 11'" by means of screws 64'", are integrally formed on the spacer elements 63'". The plate 62'" comprises an anti-rotation protection opening 61'", which is realized as an elongated hole, through which the ultrasound conductor 25'" is also guided.

As a result of realizing the anti-rotation protection opening 61'" as an elongated hole and as a result of the rectangular cross sectional form of the ultrasound conductor 25'" and as a result of suitable dimensioning, the anti-rotation protection opening 61'" only allows rotation of the ultrasound conductor 25'" about its longitudinal axis within a predetermined angular range. For example, the angular range can be 10° such that the anti-rotation protection opening 61'" permits a rotation of the ultrasound conductor 25'" around a central angular position in both directions of rotation by a maximum of 5°. In this way, the fastening of the resonator 15'" on the screen surface 13'" can be protected when a holding structure, holding the ultrasound conductor 25'", for example a fastening tube 45' shown in FIG. 6, is fastened on the screen support 13". Sealing means, not shown here, which can prevent the screening material passing though the feed-through opening 24'", can be introduced between the plate 62'" with the anti-rotation protection opening 61'" formed therein and the screen support 11'".

As the fifth exemplary embodiment, FIGS. 9*a* to 9*c* show a slightly modified variant of the screening system shown in FIG. 8. FIG. 9*a* shows the screening system 10"" without the anti-rotation safeguard 60"" which is shown in detail in FIG. 9*b*. This screening system 10"" also includes two substantially annular screen supports (only one first screen support 11"" of which can be seen here), a screen surface 13"" which is in the form of a lateral cylinder surface and a resonator 15"" which is realized in a similar manner to the resonator 15" shown in FIGS. 5*a* to 6 and is fastened directly on the screen surface 13"". The resonator 15"" is actuatable by ultrasound vibrations by means of an ultrasound conductor 25"".

The ultrasound conductor 25"" comprises a first portion 69"" with a circular cross section which faces an ultrasound converter, and a second portion 70"" with a rectangular cross section which faces the resonator 15"". The first portion 69"" is guided through a feed-through opening 24"" which is formed in a collar-shaped portion 18"" of the first screen support 11"".

A plate 62"" of the anti-rotation safeguard 60"", which is shown in detail in FIG. 9*b*, comprises an anti-rotation protection opening 61"", through which the second portion 70"" of the ultrasound conductor 25"" is guided (see FIG. 9*c* in this respect). The anti-rotation protection opening 61"" is open on one side, inwardly in the radial direction with reference to a central axis of the screening system. More precisely, the anti-rotation protection opening 61"" includes a circle-segment-shaped portion 67"" which merges into a slot 68"" which widens inwardly in the radial direction, at the end of which the anti-rotation protection opening 61"" is open.

For assembly, the anti-rotation safeguard 60"" can be displaced inwardly in the radial direction above the ultrasound conductor 25"", which penetrates in part into the annular portion 67"" through the slot 68"", and then is fixed by means of screws 64"". The screws 64"" are realized as hexagon socket screws in FIG. 9*c*. In the end position, which is achieved as a result, there is no contact between the ultrasound conductor 25"" and the plate 62"".

As a result of said realization in FIGS. 9*a* to 9*c* also, the anti-rotation protection opening 61" " allows rotation of the ultrasound conductor 25"" about its longitudinal axis only within a predetermined angular range. Said rotatability is made possible, among other things, as a result of the slot 68"" being widened inwardly in the radial direction.

FIGS. 10*a* to 10*d* show a sixth exemplary embodiment according to the invention of a screening system 10""" with a first circular ring-shaped screen support 11""" and a second circular ring-shaped screen support 12""", both of which are designed in a substantially mirrored manner with respect to one another. Pressure rods 14""" brace the screen supports 11'''', 12'''' together in such a manner that compressive stress is generated between the screen supports 11'''', 12''''. A screen surface 13'''' which is in the form of a circular lateral cylinder surface and extends in a longitudinal direction L is clamped between the screen supports 11'''', 12'''' by means of two hose clips 76''''. The first screen support 11'''' comprises a sleeve-shaped portion 16'''' and a collar-shaped portion 18'''' which protrudes radially outwardly from the sleeve-shaped portion. In an analogous manner, the second screen support 12'''' comprises a sleeve-shaped portion which cannot be seen here and a collar-shaped portion 19'''' which protrudes radially outwardly from the sleeve-shaped portion.

A resonator 15'''', which is designed identically to that shown in FIGS. 5*a* to 6, extends along the longitudinal direction L from the first screen support 11'''' substantially to the second screen support 12''''. The resonator 15'''' is excited by means of an ultrasound converter 77'''' and an ultrasound conductor 25'''' to form ultrasound vibrations. The ultrasound converter 77'''' is held on the collar-shaped portion 18'''' of the first screen support 11'''' by means of a plate-shaped converter holder 79'''' and two spacers 78''''. The ultrasound conductor 25'''' is guided through a feed-through opening 24''''. An anti-rotation safeguard as shown in FIGS. 8 to 9*c* can also be provided here as an option.

FIG. 10*d* shows the detail A from FIG. 10*b* in an enlarged manner. On an axial end 74'''' facing the second screen support 12'''', the sleeve-shaped portion 16'''' of the first screen support 11'''' comprises a groove 71'''' on its radial outer side 73''''. A sealing ring realized as an O-ring seal 72'''' is inserted in said groove 71''''. The O-ring seal 72'''' protrudes slightly outwardly in the radial direction above the groove 71'''' (which is not shown in the figures to simplify the drawing). The screen surface 13'''' is clamped in the radial direction by means of said O-ring seal 72''''. An axial end of the screen surface 13'''' is held by means of a hose clip 76'''' on an axial end 75'''' of the sleeve-shaped portion 16'''' facing away from the second screen support 12''''.

FIGS. 11*a* and 11*b* show the first screen support 11'''' again in a separate and enlarged manner, FIG. 11*b* showing the detail X from FIG. 11*a*. A sleeve-shaped continuation 80'''' extends from the sleeve-shaped portion 16'''' in the direction of the second screen support 12''''. It is thinner than the sleeve-shaped portion 16'''' in the radial direction, but runs flush with the sleeve-shaped portion 16'''' on the radial inner side 82''''. A thickening 81'''' extends radially outwardly from the end of the sleeve-shaped continuation 80''''. The groove 71'''' is formed by an end face 83'''' of the sleeve-shaped portion 16'''', by the sleeve-shaped continuation 80'''' and by the thickening 81''''. In this case, the thickening 81'''' has a radial extent which is smaller than the radial extent of the end face 83''''. This makes it easier to introduce the O-ring seal 72'''' into the groove 71''''. As the screen surface 13'''' is clamped away from the thickening 83'''' in the axial direction by means of the hose clip 76'''', the O-ring seal 72'''' is prevented from slipping out of the groove 71''''.

The invention claimed is:

1. A screening system, including at least one first substantially annular screen support and a second substantially annular screen support, at least one pressure rod which braces the screen supports together in such a manner that compressive stress is generated between the screen supports, at least one screen surface which is substantially in the form of a lateral cylinder surface and is clamped between the screen supports, at least one resonator for introducing ultrasound vibrations directly into the screen surface, wherein the resonator is fastened on the screen surface and extends substantially from the first screen support to the second screen support.

2. The screening system according to claim 1, wherein the first screen support and the second screen support are formed substantially circular ring-shaped manner and the screen surface is formed substantially in the form of a circular lateral cylinder surface.

3. The screening system according to claim 1, wherein the resonator is held on the first screen support and/or on the second screen support.

4. The screening system according to claim 3, wherein the resonator comprises a first vibration node, on which it is held on the first screen support, and/or a second vibration node, on which it is held on the second screen support.

5. The screening system according to claim 4, wherein the resonator on the first vibration node is held on the first screen support by means of a first decoupling element and/or on the second vibration node is held on the second screen support by means of a second decoupling element.

6. The screening system according to claim 1, wherein at least one screen support comprises a sleeve-shaped portion on which the screen surface is fastened, as well as a collar-shaped portion which protrudes radially outwardly from the sleeve-shaped portion, on which the at least one pressure rod is fastened.

7. The screening system according to claim 1, wherein the screening system includes at least one ultrasound conductor, by means of which the resonator is actuatable by ultrasound vibrations, wherein the at least one ultrasound conductor is guided through a feed-through opening formed in the first screen support into an intermediate region formed between the first screen support and the second screen support.

8. The screening system according to claim 1, wherein the resonator extends substantially in the longitudinal direction from the first screen support to the second screen support.

9. The screening system according to claim 1, wherein the resonator is realized for introducing ultrasound vibrations which comprise substantially only a component in the longitudinal direction.

10. The screening system according to claim 1, wherein the resonator is fastened on the screen surface substantially along an entire length of the resonator.

11. The screening system according to claim 1, wherein the resonator is glued or soldered to the screen surface.

12. The screening system according to claim 1, wherein the resonator is arranged on an outer side of the screen surface and is fastened there to said outer side of the screen surface.

13. The screening system according to claim 1, wherein the screening system includes multiple resonators.

14. The screening system according to claim 13, wherein the multiple resonators are distributed uniformly around a circumference of the screen surface.

15. The screening system according to claim 7, wherein the screening system additionally includes one or multiple ultrasound converters for generating the ultrasound vibrations which are feedable to the at least one ultrasound conductor.

16. The screening system according to claim 1, wherein the screening system includes at least one third substantially annular screen support, at least two screen surfaces which are substantially in the form of a lateral cylinder surface and at least two resonators for introducing ultrasound vibrations into the screen surfaces, wherein a first of the screen surfaces is clamped between the first screen support and the second screen support and a second of the screen surfaces is clamped between the second screen support and the third screen support, at least one first of the resonators is adapted to introduce ultrasound vibrations directly into the first screen surface and at least one second of the resonators is adapted to introduce ultrasound vibrations directly into the second screen surface, the screening system additionally includes a first ultrasound conductor, by means of which the first resonator is actuatable by ultrasound vibrations, as well as a second ultrasound conductor, by means of which the second resonator is actuatable by ultrasound vibrations, the first ultrasound conductor is guided through a feed-through opening formed in the first screen support and the second ultrasound conductor is guided through a first feed-through opening formed in the first screen support and a second feed-through opening formed in the second screen support.

17. The screening system according to claim 16, wherein the first ultrasound conductor is connected or connectable to a first ultrasound converter and the second ultrasound conductor is connected or connectable to a second ultrasound converter, wherein the first ultrasound conductor and the second ultrasound conductor are connected or connectable to one and the same generator.

18. The screening system according to claim 16, wherein the second ultrasound conductor and the second resonator are offset in the circumferential direction in relation to the first ultrasound conductor and the first resonator with reference to a central axis of the screening system by an angle within the range of between 90° and 270°.

* * * * *